US009093042B2

(12) United States Patent
Park et al.

(10) Patent No.: US 9,093,042 B2
(45) Date of Patent: Jul. 28, 2015

(54) TRANSPARENT DISPLAY APPARATUS

(75) Inventors: Jae Hwa Park, Gumi-si (KR); Jang-Il Kim, Asan-si (KR); Hyun-Ho Kang, Ansan-si (KR); Swae-Hyun Kim, Asan-si (KR); Yongwoo Hyung, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 320 days.

(21) Appl. No.: 13/462,934

(22) Filed: May 3, 2012

(65) Prior Publication Data

US 2013/0162616 A1 Jun. 27, 2013

(30) Foreign Application Priority Data

Dec. 22, 2011 (KR) ..... 10-2011-0140486

(51) Int. Cl.
*G09G 3/36* (2006.01)

(52) U.S. Cl.
CPC ..... *G09G 3/3648* (2013.01); *G09G 2300/0452* (2013.01); *G09G 2300/08* (2013.01)

(58) Field of Classification Search
CPC ..... G02F 1/13454; G02F 1/133514; G02F 1/133371; G02F 1/134336; G02F 1/133553; G02F 2001/136222; G09G 3/3648; G09G 2300/0452; G09G 3/2003; G09G 3/2074; G09G 3/3607; G09G 3/3674; G09G 2300/08; G09G 2320/066; G09G 3/342; G09G 3/3426; G09G 3/3611; G09G 2300/0456; G09G 2320/0276; G09G 2300/0426; G09G 2300/0439; G09G 2310/0235; G09G 2320/0233; G02B 5/20; G02B 5/201
USPC ..... 345/211, 87, 694–695, 698, 3.3; 349/75, 96, 106, 113, 114, 129, 130, 349/158, 187
See application file for complete search history.

(56) References Cited

U.S. PATENT DOCUMENTS

| | | | | |
|---|---|---|---|---|
| 6,522,377 | B2 | 2/2003 | Kim et al. | |
| 7,312,841 | B2 | 12/2007 | Lee et al. | |
| 7,782,427 | B2 | 8/2010 | Son et al. | |
| 2003/0151709 | A1 * | 8/2003 | Sakamoto | 349/113 |
| 2009/0207328 | A1 * | 8/2009 | Hur et al. | 349/37 |
| 2009/0262289 | A1 * | 10/2009 | Koma et al. | 349/114 |
| 2010/0149475 | A1 * | 6/2010 | Kim et al. | 349/123 |
| 2010/0283714 | A1 * | 11/2010 | Cho et al. | 345/90 |
| 2010/0289884 | A1 | 11/2010 | Kang | |
| 2010/0321620 | A1 | 12/2010 | Son et al. | |

FOREIGN PATENT DOCUMENTS

| | | |
|---|---|---|
| JP | 2007-025689 | 2/2007 |
| KR | 1020030081977 | 10/2003 |

* cited by examiner

*Primary Examiner* — Amare Mengistu
*Assistant Examiner* — Gloryvid Figueroa-Gibson
(74) *Attorney, Agent, or Firm* — F. Chau & Associates, LLC

(57) ABSTRACT

A transparent display apparatus includes a display panel including a plurality of pixels arranged in rows and columns, a plurality of gate lines, a plurality of data lines including first and second data lines, a gate driver, and a data driver. Each of the pixels comprises sub-pixels arranged in a row direction, each gate line is operatively coupled to sub-pixels arranged in a corresponding row, and each first and second data line is operatively coupled to sub-pixels arranged in a corresponding column. The gate driver sequentially applies a gate signal to the pixels through the gate lines. The data driver applies sub-data signals to the sub-pixels through the first data lines, and applies down data signals to the sub-pixels through the second data lines. Each of the down data signals has a voltage level lower than a voltage level of a corresponding sub-data signal.

14 Claims, 13 Drawing Sheets

TRANSPARENT DISPLAY APPARATUS

CROSS-REFERENCE TO RELATED APPLICATION

This application claims priority under 35 U.S.C. §119 to Korean Patent Application No. 10-2011-0140486, filed on Dec. 22, 2011, the disclosure of which is incorporated by reference herein in its entirety.

TECHNICAL FIELD

The present invention relates to a transparent display apparatus. More particularly, the present invention relates to a transparent display apparatus capable of reducing or preventing display defects.

DISCUSSION OF THE RELATED ART

A transparent display apparatus displays an image while also maintaining a level of transparency. A transparent display apparatus may include a panel on which a plurality of pixels are formed. Each pixel may include sub-pixels (e.g., red, green, and blue sub-pixels), and each sub-pixel may include a color filter area and an open area. The open area is defined by an area of the sub-pixel that does not include the color filter. When a data voltage is applied to each sub-pixel, the transmittance of the light passing through the open area is higher than the transmittance of the light passing through the color filter area. Further, since red, green, and blue light have different wavelengths from each other, the color filter areas in each of the sub-pixels have different light transmittances from each other, and increase rates of the transmittance of the light passing through the open areas in the sub-pixels become different from each other. As a result, display defects such as, for example, a yellowish discoloration, may occur.

SUMMARY

Exemplary embodiments of the present invention provide a transparent display apparatus capable of reducing or preventing display defects such as, for example, a yellowish discoloration.

According to an exemplary embodiment, a transparent display apparatus includes a display panel, a plurality of gate lines, a plurality of data lines, a gate driver, and a data driver. The display panel includes a plurality of pixels arranged in rows and columns, and each of the pixels includes a plurality of sub-pixels arranged in a row direction. Each of the gate lines is connected to the sub-pixels arranged in a corresponding row. The data lines include first data lines and second data lines, and each of the first data lines is connected to the sub-pixels arranged in a corresponding column together with a corresponding second data line of the second data lines. The gate driver generates a gate signal and sequentially applies the gate signal to the pixels through the gate lines. The data driver generates a plurality of sub-data signals respectively applied to the sub-pixels through the first data lines and a plurality of down data signals respectively applied to the sub-pixels through the second data lines. Each of the down data signals has a voltage level lower than and different from a voltage level of a corresponding sub-data signal of the sub-data signals.

In an exemplary embodiment, each of the sub-pixels includes a color filter area and an open area, and each of the color filter area and the open area has a rectangular shape.

In an exemplary embodiment, the color filter area includes a first thin-film transistor turned on in response to the gate signal provided through a corresponding gate line of the gate lines, and a first pixel electrode that receives a corresponding sub-data signal of the sub-data signals through the first data line connected to the first pixel electrode by the turned-on first thin-film transistor. The open area includes a second thin-film transistor turned on in response to the gate signal provided through a corresponding gate line of the gate lines, and a second pixel electrode that receives a corresponding down data signal of the down data signals through the second data line connected to the second pixel electrode by the turned-on second thin-film transistor.

In an exemplary embodiment, the sub-data signals include a first sub-data signal, a second sub-data signal, and a third sub-data signal, and the down data signals include a first down data signal, a second down data signal, and a third down data signal. The first, second, and third sub-data signals are applied to the color filter areas of the sub-pixels, and the first, second, and third down data signals are applied to the open areas of the sub-pixels.

In an exemplary embodiment, the first, second, and third down data signals have different levels from each other, the level of the first down data signal is lower than the level of the second down data signal, and the level of the second down data signal is lower than the level of the third down data signal.

In an exemplary embodiment, the open area has a light transmittance substantially equal to a light transmittance of the color filter area in each sub-pixel.

According to an exemplary embodiment, a transparent display apparatus includes a display panel, a plurality of gate lines, a plurality of data lines, a gate driver, and a data driver. The display panel includes a plurality of pixels arranged in rows and columns, and each of the pixels includes a plurality of sub-pixels arranged in a row direction. The gate lines include first gate lines and second gate lines, and each of the first gate lines is connected to the sub-pixels arranged in a corresponding row together with a corresponding second gate line of the second gate lines. The data lines are insulated from the gate lines, and each of the data lines is connected to the sub-pixels arranged in a corresponding column. The gate driver sequentially applies a gate signal to the pixels through the first and second gate lines. The data driver generates a plurality of sub-data signals respectively applied to the sub-pixels through the data lines in response to the gate signal provided through the first gate lines, and a plurality of down data signals respectively applied to the sub-pixels through the data lines through the second gate lines, each of which is disposed after a corresponding one of the first gate lines. Each of the down data signals has a level lower than and different from a level of a corresponding sub-data signal of the sub-data signals.

According to an exemplary embodiment, a transparent display apparatus includes a display panel, a plurality of gate lines, and a plurality of data lines.

In an exemplary embodiment, the display panel includes a plurality of pixels arranged in rows and columns, and each of the pixels includes a plurality of sub-pixels arranged in a row direction. The gate lines sequentially receive a gate signal and are connected to the sub-pixels arranged in a corresponding row. The data lines receive a data signal and are connected to the sub-pixels arranged in a corresponding column.

In an exemplary embodiment, each of the sub-pixels includes a color filter area and an open area, and the color filter area includes a first thin-film transistor and a first liquid crystal capacitor. The first thin-film transistor is turned on in response to the gate signal provided from a corresponding current stage through a corresponding gate line of the gate lines. The first liquid crystal capacitor receives the data signal through a corresponding data line of the data lines, which is connected to the first liquid crystal capacitor through the turned-on first thin-film transistor In an exemplary embodiment, the open area includes a second thin-film transistor, a second liquid crystal capacitor, a third thin-film transistor, and a down capacitor. The second thin-film transistor is turned on in response to the gate signal provided from a corresponding current stage through a corresponding gate line of the gate lines. The second liquid crystal capacitor receives the data signal through a corresponding data line of the data lines, which is connected to the second liquid crystal capacitor through the turned-on second thin-film transistor. The third thin-film transistor is turned on in response to the gate signal provided through a corresponding gate line of the gate lines, which is of a next stage. The down capacitor is connected to the second liquid crystal capacitor through the turned-on third thin-film transistor. The first and second liquid crystal capacitors are charged with a pixel voltage having a same voltage level in response to the gate signal provided through the gate line of the current stage. The pixel voltage charged in the second liquid crystal capacitor is level-shifted down by a previous pixel voltage charged in the down capacitor during a previous frame in response to the gate signal provided through the gate line of the next stage. The down capacitors of the sub-pixels have different sizes from each other.

According to an exemplary embodiment, a transparent display apparatus includes a display panel, a plurality of gate lines, and a plurality of data lines. The display panel includes a plurality of pixels arranged in rows and columns, and each of the pixels include a plurality of sub-pixels arranged in a row direction. The gate lines sequentially receive a gate signal and are connected to the sub-pixels arranged in a corresponding row. The data lines receive a data signal and are connected to the sub-pixels arranged in a corresponding column.

In an exemplary embodiment, each of the sub-pixels includes a color filter area and an open area. The color filter area includes a first thin-film transistor and a first liquid crystal capacitor. The first thin-film transistor is turned on in response to the gate signal provided through a corresponding gate line of the gate lines. The first liquid crystal capacitor receives the data signal through a corresponding data line of the data lines, which is connected to the first liquid crystal capacitor through the turned-on first thin-film transistor. The open area includes a second thin-film transistor, a second liquid crystal capacitor, and a down thin-film transistor. The second thin-film transistor is turned on in response to the gate signal provided through a corresponding gate line of the gate lines. The second liquid crystal capacitor receives the data signal through a corresponding data line of the data lines, which is connected to the second liquid crystal capacitor through the turned-on second thin-film transistor. The down thin-film transistor is turned on in response to the gate signal provided through a corresponding gate line of the gate lines to be connected to the second liquid crystal capacitor and applied with a storage voltage. A range of the voltage level of the data signal is set wider than a range of the voltage level of the storage voltage. A voltage at a contact point between the turned-on second thin-film transistor and the turned-on down thin-film transistor has a voltage level corresponding to an intermediate level between the data signal and the storage voltage. The down thin-film transistors of the sub-pixels have different sizes from each other.

According to an exemplary embodiment, a transparent display apparatus includes a display panel including a plurality of pixels arranged in a plurality of rows and columns, a plurality of gate lines, a plurality of data lines including first and second data lines, a gate driver, and a data driver. Each of the pixels includes a plurality of sub-pixels arranged in a row direction. Each gate line is operatively coupled to sub-pixels arranged in a corresponding row. The plurality of data lines includes first data lines and second data lines. Each first and second data line is operatively coupled to sub-pixels arranged in a corresponding column. The gate driver is configured to sequentially apply a gate signal to the pixels through the gate lines. The data driver is configured to apply a plurality of sub-data signals to the sub-pixels through the first data lines, and apply a plurality of down data signals to the sub-pixels through the second data lines. Each of the down data signals has a voltage level lower than a voltage level of a corresponding sub-data signal.

According to an exemplary embodiment, a transparent display apparatus includes a display panel including a plurality of pixels arranged in a plurality of rows and columns, a plurality of gate lines including first gate lines and second gate lines, a plurality of data lines, a gate driver, and a data driver. Each of the pixels includes a plurality of sub-pixels arranged in a row direction. Each first and second gate line is operatively coupled to sub-pixels arranged in a corresponding row. Each data line is operatively coupled to sub-pixels arranged in a corresponding column. The gate driver is configured to sequentially apply a gate signal to the pixels through the first and second gate lines. The data driver is configured to apply a plurality of sub-data signals to the sub-pixels through the data lines in response to the gate signal provided through the first gate lines, and apply a plurality of down data signals to the sub-pixels through the data lines in response to the gate signal provided through the second gate lines. Each of the second gate lines is disposed adjacent to a corresponding one of the first gate lines, and each of the down data signals has a voltage level lower than a voltage level of a corresponding sub-data signal.

According to an exemplary embodiment, a transparent display apparatus includes a display panel including a plurality of pixels arranged in a plurality of rows and columns, a plurality of gate lines operatively coupled to sub-pixels arranged in a corresponding row and configured to sequentially receive a gate signal, and a plurality of data lines operatively coupled to sub-pixels arranged in a corresponding column and configured to receive a data signal. Each of the pixels includes a plurality of sub-pixels arranged in a row direction. Each of the sub-pixels includes a color filter area and an open area. The color filter area includes a first thin-film transistor configured to be turned on in response to the gate signal provided through a corresponding gate line during a current stage, and a first liquid crystal capacitor configured to receive the data signal through a corresponding data line operatively coupled to the first liquid crystal capacitor through the turned-on first thin film transistor. The open area includes a second thin-film transistor configured to be turned on in response to the gate signal provided through a corresponding gate line during the current stage, a second liquid crystal capacitor configured to receive the data signal through a corresponding data line operatively coupled to the second liquid crystal capacitor through the turned-on second thin film transistor, a third thin-film transistor configured to be turned on in response to the gate signal provided through a corresponding gate line during a next stage, and a down capacitor operatively coupled to the second liquid crystal capacitor through the turned-on third thin-film transistor. The first and second liquid crystal capacitors are configured to be charged with a pixel voltage having a same voltage level in response to the gate signal provided during the current stage, the pixel voltage charged in the second liquid crystal capacitor is level-shifted down by a previous pixel voltage charged in the down capacitor during a previous frame in response to the gate signal provided during the next stage, and the down capacitor in each of the sub-pixels have different sizes from each other.

According to an exemplary embodiment, a transparent display apparatus includes a display panel including a plurality of pixels arranged in a plurality of rows and columns, a plurality of gate lines operatively coupled to sub-pixels arranged in a corresponding row and configured to sequentially receive a gate signal, and a plurality of data lines operatively coupled to sub-pixels arranged in a corresponding column and configured to receive a data signal. Each of the pixels includes a plurality of sub-pixels arranged in a row direction. Each of the sub-pixels includes a color filter area and an open area. The color filter area includes a first thin-film transistor configured to be turned on in response to the gate signal provided through a corresponding gate line, and a first liquid crystal capacitor configured to receive the data signal through a corresponding data line operatively coupled to the first liquid crystal capacitor through the turned-on first thin-film transistor. The open area includes a second thin-film transistor configured to be turned on in response to the gate signal provided through a corresponding gate line, a second liquid crystal capacitor configured to receive the data signal through a corresponding data line operatively coupled to the second liquid crystal capacitor through the turned-on second thin-film transistor, and a down thin-film transistor configured to be turned on in response to the gate signal provided through a corresponding gate line. The down thin-film transistor is operatively coupled to the second liquid crystal capacitor, a storage voltage is applied to the open area through the turned-on down thin-film transistor, a range of a voltage level of the data signal is wider than a range of a voltage level of the storage voltage, a voltage at a contact point between the turned-on second thin-film transistor and the turned-on down thin-film transistor has a voltage level corresponding to an intermediate voltage level between the data signal and the storage voltage, and the down thin-film transistor in each of the sub-pixels have different sizes from each other.

According to an exemplary embodiment, a pixel of a display panel includes a sub-pixel including a color filter area and an open area. The color filter area is configured to receive a sub-data signal through a first data line. The open area is configured to receive a down data signal through a second data line. The down data signal has a voltage level lower than a voltage level of the sub-data signal.

According to the exemplary embodiments described above, the transparent display apparatus may reduce the difference between the light transmittance of the color filter area of the sub-pixels and the light transmittance of the open area of the sub-pixels, which may reduce or prevent display defects, such as, for example, a yellowish discoloration.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION

Figure 1:
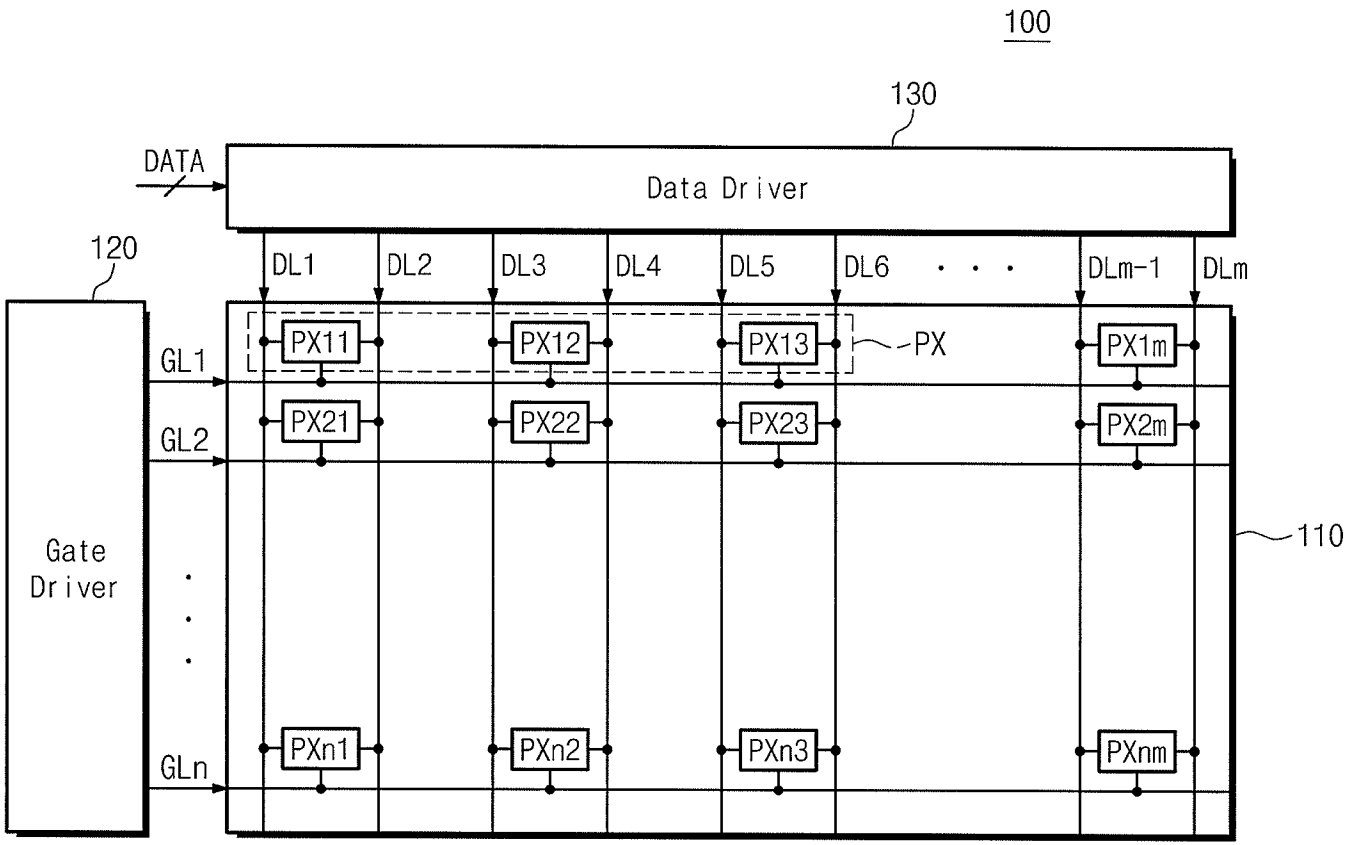
FIG. 1 is a block diagram showing a transparent display apparatus, according to an exemplary embodiment of the present invention.

Exemplary embodiments of the present invention will be described more fully hereinafter with reference to the accompanying drawings. Like reference numerals may refer to like elements throughout the accompanying drawings.

The terminology used herein is for the purpose of describing particular exemplary embodiments only and is not intended to limit the invention. As used herein, the singular terms "a," "an" and "the" are intended to include the plural forms as well, unless the context clearly indicates otherwise. As used herein, the term "and/or" includes any and all combinations of one or more of the associated listed items. It will be understood that when an element is referred to as being "connected" or "coupled" to another element, it may be directly connected or coupled to the other element or intervening elements may be present.

Similarly, it will be understood that when an element such as a layer, region or substrate is referred to as being "on," "over," "covering" or "bordering" another element, it can be directly on, over, covering or bordering the other element or intervening elements may be present. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

FIG. 1 is a block diagram showing a transparent display apparatus, according to an exemplary embodiment of the present invention.

Referring to FIG. 1, a transparent display apparatus 100 includes a display panel 110, a gate driver 120, a data driver 130, a plurality of gate lines GL1 to GLn, and a plurality of data lines DL1 to DLm.

The display panel 110 includes a plurality of pixels PX arranged in a plurality of rows and columns. Each pixel PX includes sub-pixels arranged in a row direction. The sub-pixels include a red sub-pixel, a green sub-pixel, and a blue sub-pixel. For example, each pixel PX includes red, green, and blue sub-pixels arranged in the row direction. Accordingly, the sub-pixels are arranged in n rows by m columns, where n and m are positive integers.

In an exemplary embodiment, the red, green, and blue sub-pixels are repeatedly arranged in the row direction and the column direction, however, exemplary embodiments of the present invention are not limited thereto.

Each of the gate lines GL1 to GLn is connected to the sub-pixels arranged in a corresponding row. The data lines DL1 to DLm are insulated from the gate lines GL1 to GLn, and a pair of data lines is connected to the sub-pixels arranged in a corresponding column. Hereinafter, when referring to the two data lines adjacent to a sub-pixel, one data line is referred to as a first data line and the other data line is referred to as a second data line.

The gate driver 120 generates a gate signal (e.g., a gate voltage) in response to a gate control signal provided from a timing controller. The gate driver 120 sequentially applies the gate signal to the pixels through the gate lines GL1 to GLn.

The data driver 130 generates data signals (e.g., data voltages) in response to a data control signal provided from the timing controller. The data driver 130 applies the data signals to the pixels through the data lines DL1 to DLm.

The data signals include a plurality of sub-data signals and a plurality of down data signals corresponding to the sub-data signals. Each of the down data signals has a voltage level lower than that of a corresponding sub-data signal.

For example, the data signals include a first sub-data signal (e.g., a red data signal), a second sub-data signal (e.g., a green data signal), a third sub-data signal (e.g., a blue data signal), and first, second, and third down data signals respectively corresponding to the first, second, and third sub-data signals. The first down data signal has a voltage level lower than that of the first sub-data signal, the second down data signal has a voltage level lower than that of the second sub-data signal, and the third down data signal has a voltage level lower than that of the third sub-data signal. In addition, the first to third down data signals have different voltage levels from each other.

Each sub-pixel includes a color filter area and an open area. Each of the first to third sub-data signals is applied to the color filter area of the sub-pixels through a corresponding first data line, and each of the first to third down data signals is applied to the open area of the sub-pixels through a corresponding second data line.

The first to third down data signals are used to control a difference between the light transmittance of the color filter area of the sub-pixels and the light transmittance of the open area of the sub-pixels. Thus, the difference between the light transmittance of the color filter area of the sub-pixels and the light transmittance of the open area of the sub-pixels is reduced by the first to the third down data signals.

An increase rate of the light transmittance of the open area of the red sub-pixel, an increase rate of the light transmittance of the open area of the green sub-pixel, and an increase rate of the light transmittance of the open area of the blue sub-pixel are different from each other. Since the increase rates of the light transmittances of the open areas of the sub-pixels are different from each other, the first to third down data signals used to reduce the light transmittance of the open areas have different voltage levels from each other.

As a result, the transparent display apparatus 100 may reduce the difference between the light transmittance of the color filter area of each of the red, green, and blue sub-pixels and the light transmittance of the open area of each of the red, green, and blue sub-pixels, which may prevent or reduce display defects such as, for example, a yellowish discoloration.

The ratio of the first to third down data voltages applied to the sub-pixels and the configuration of the sub-pixels will be described in more detail with reference to FIGS. 2 to 5.

FIGS. 2A to 2D are plan views showing a configuration of an individual pixel of the display panel shown in FIG. 1, according to an exemplary embodiment of the present invention.

Figure 2A:
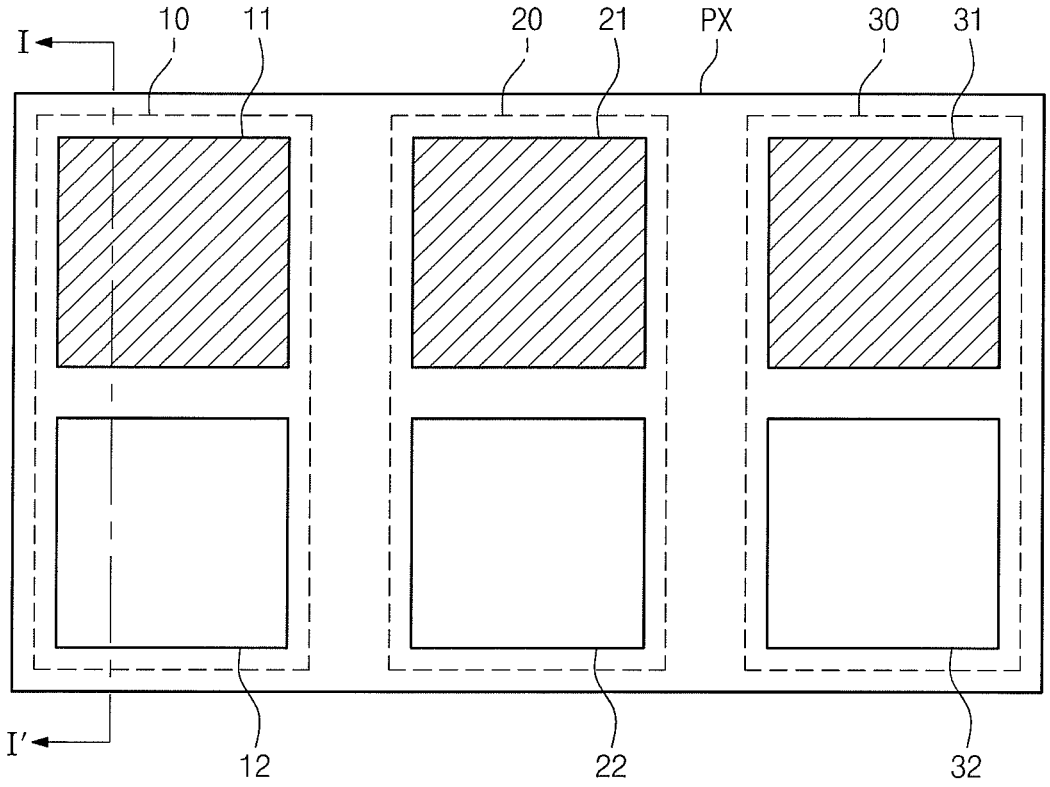
FIGS. 2A to 2D are plan views showing a configuration of an individual pixel of the display panel shown in FIG. 1, according to an exemplary embodiment of the present invention.

Referring to FIG. 2A, the pixel PX includes the sub-pixels 10, 20, and 30, and each of the sub-pixels 10, 20, and 30 includes a corresponding color filter area 11, 21, and 31 and a corresponding open area 12, 22, and 32. Each of the sub-pixels 10, 20, and 30 may display one of red, green, and blue colors, and an arrangement of the red, green, and blue colors displayed by the sub-pixels 10, 20, and 30 may be changed. Hereinafter, the sub-pixels 10, 20, and 30 are referred to as a red sub-pixel 10 displaying the red color, a green sub-pixel 20 displaying the green color, and a blue sub-pixel 30 displaying the blue color, respectively, however, the arrangement of the sub-pixels 10, 20, and 30 is not limited thereto.

In FIG. 2A, the color filter areas 11, 21, and 31 are respectively positioned at upper portions of the sub-pixels 10, 20, and 30, and the open areas 12, 22, and 32 are respectively positioned at lower portions of the sub-pixels 10, 20, and 30, however, the arrangement of the color filter areas 11, 21, and 31 and the open areas 12, 22, and 32 is not limited thereto. For example, in exemplary embodiments, the color filter areas 11, 21, and 31 may be positioned at the lower portions of the sub-pixels 10, 20, and 30, and the open areas 12, 22, and 32 may be positioned at the upper portions of the sub-pixels 10, 20, and 30. In addition, the color filter areas 11, 21, and 31 and the open areas 12, 22, and 32 may be positioned at left and right portions of the sub-pixels 10, 20, and 30.

The color filter areas 11, 21, and 31 and the open areas 12, 22, and 32 shown in FIG. 2A have a rectangular shape, however, the shape of the color filter areas 11, 21, and 31 and the open areas 12, 22, and 32 is not limited thereto. For example, the color filter areas 11, 21, and 31 and the open areas 12, 22, and 32 may have a variety of other shapes, including a lattice shape.

In FIG. 2A, the open areas 12, 22, and 32 have the same area, and the area of the open areas 12, 22, and 32 is to the same as the area of the color filter areas 11, 21, and 31, however, exemplary embodiments of the present invention are not limited thereto. For example, the color filter areas 11, 21, and 31 may have a larger area than the open areas 12, 22, and 32. In this case, a color reproducibility of the red, green, and blue colors may be improved, and thus, vividness of the red, green, and blue colors may be improved.

Figure 2B:
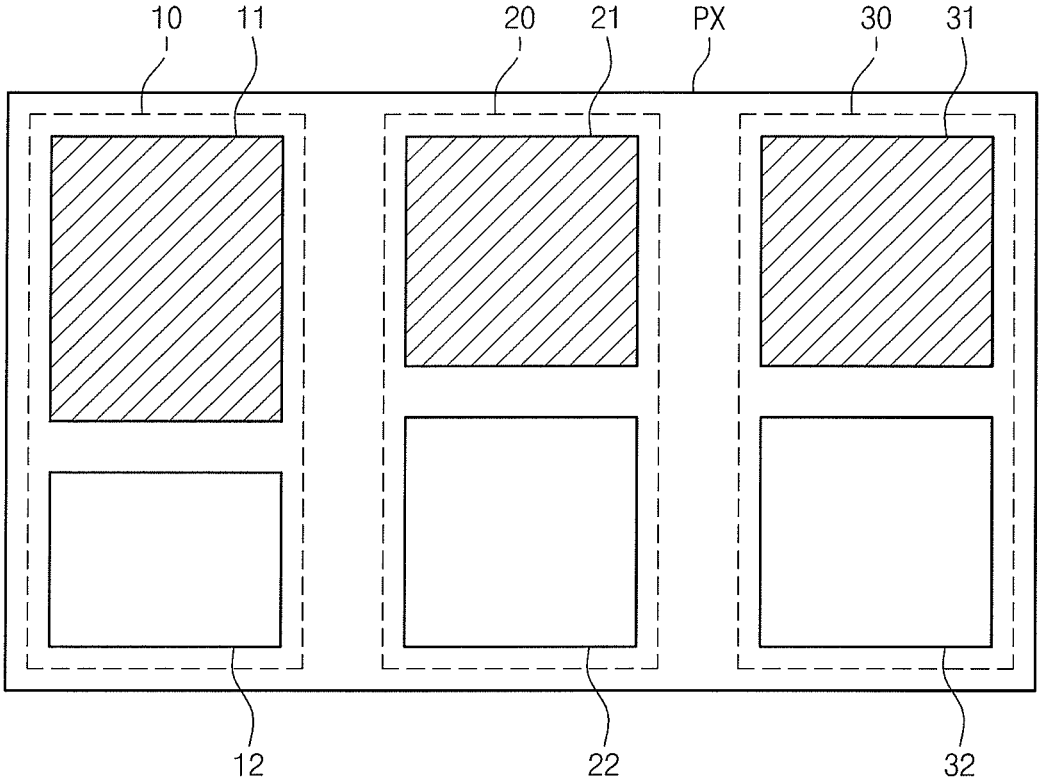
Figure 2C:
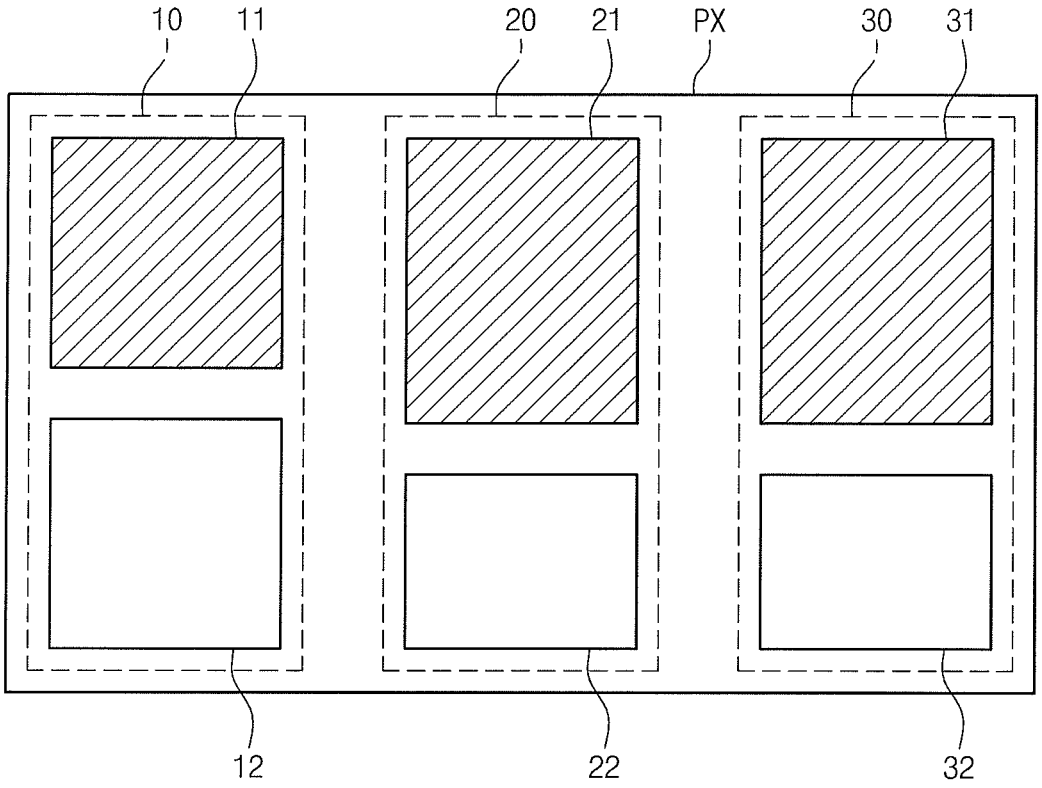
Figure 2D:
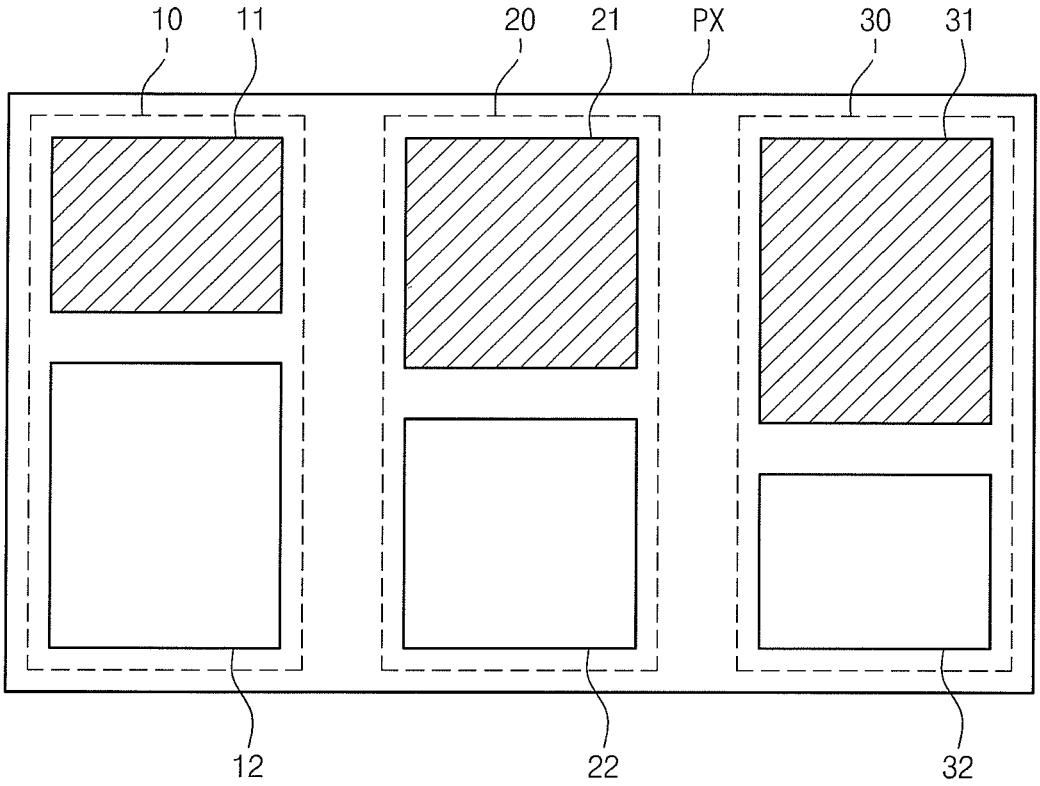

In addition, the open areas 12, 22, and 32 may have different areas from each other, as shown in FIGS. 2B to 2D.

Referring to FIG. 2B, the area of the open area 12 of the red sub-pixel 10 is smaller than that of the open area 22 of the green sub-pixel 20 and the open area 32 of the blue sub-pixel 30. Accordingly, the area of the color filter area 11 of the red sub-pixel 10 is larger than that of the color filter area 21 of the green sub-pixel 20 and the color filter area 31 of the blue sub-pixel 30. As a result, the color reproducibility of the red color may be higher than the color reproducibility of the green and blue colors.

Referring to FIG. 2C, the area of the open area 12 of the red sub-pixel 10 is larger than that of the open area 22 of the green sub-pixel 20 and the open area 32 of the blue sub-pixel 30. Accordingly, the area of the color filter area 11 of the red sub-pixel 10 is smaller than that of the color filter area 21 of the green sub-pixel 20 and the color filter area 31 of the blue sub-pixel 30. As a result, the color reproducibility of the red color may be lower than the color reproducibility of the green and blue colors.

Referring to FIG. 2D, the open areas 12, 22, and 32 of the red, green, and blue sub-pixels 10, 20, and 30 have different sizes from each other. For example, the area of the open area 12 of the red sub-pixel 10 is larger than the area of the open area 22 of the green sub-pixel 20, and the area of the open area 22 of the green sub-pixel 20 is larger than the area of the open area 32 of the blue sub-pixel 30. In this case, the area of the color filter area 11 of the red sub-pixel 10 is smaller than the area of the color filter area 21 of the green sub-pixel 20, and the area of the color filter area 21 of the green sub-pixel 20 is smaller than the area of the color filter area 31 of the blue sub-pixel 30. Thus, the color reproducibility of the blue color may be higher than the color reproducibility of the green color, and the color reproducibility of the green color may be higher than the color reproducibility of the red color.

In FIG. 2D, the open area 12 of the red sub-pixel 10 has the largest area of the open areas 12, 22, and 32, and the color filter area 31 of the blue sub-pixel 30 has the largest area of the color filter areas 11, 21, and 31, however, exemplary embodiments of the present invention are not limited thereto. For example, in exemplary embodiments, the ratio between the open areas 12, 22, and 32 and the color filter areas 11, 21, and 31 of the red, green, and blue sub-pixels 10, 20, and 30 may be differently set.

Figure 3:
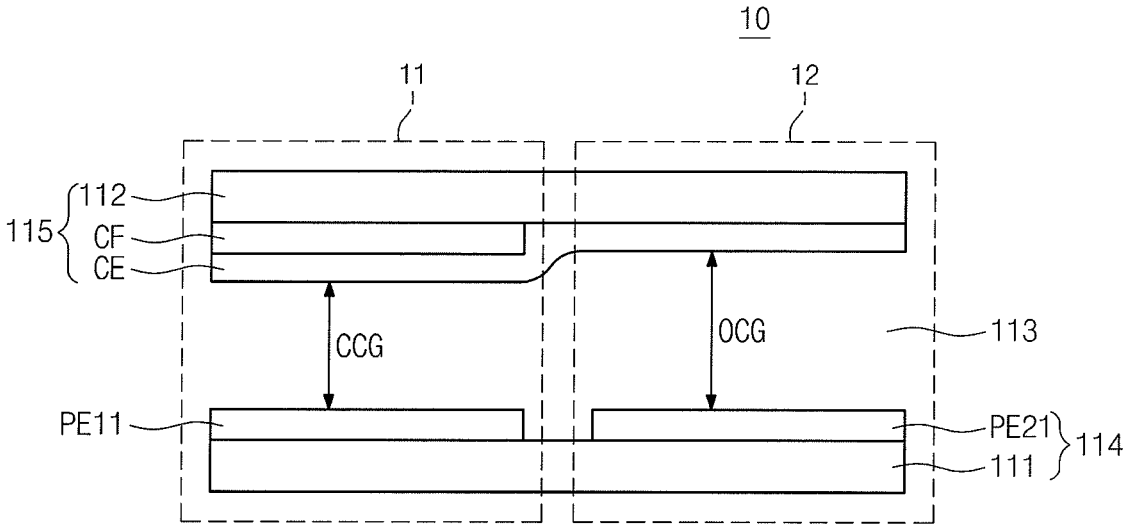
FIG. 3 is a cross-sectional view taken along line I-I' shown in FIG. 2A.

FIG. 3 is a cross-sectional view taken along line I-I' shown in FIG. 2A.

Referring to FIG. 3, the red sub-pixel 10 includes a first substrate 114, a second substrate 115 facing the first substrate 114, and a liquid crystal layer 113 disposed between the first substrate 114 and the second substrate 115.

The first substrate 114 includes a first base substrate 111, a first pixel electrode PE11 disposed on the first base substrate 111, and a second pixel electrode PE21 disposed on the first base substrate 111 and spaced apart from the first pixel electrode PE11.

The second substrate 115 includes a second base substrate 112, a color filter substrate CF disposed on a lower surface of the second base substrate 112 and overlapped with the first pixel electrode PE11, and a common electrode CE disposed on the lower surface of the second base substrate 112 and covering the color filter substrate CF. The color filter substrate CF is a red color filter substrate.

The color filter area 11 of the red sub-pixel 10 includes a portion of the first base substrate 111, the first pixel electrode PE11 disposed on the first base substrate 111, a portion of the second base substrate 112, the color filter substrate CF disposed on the lower surface of the second base substrate 112, and a portion of the common electrode CE, which is disposed on the color filter substrate CF.

The open area 12 of the red sub-pixel 10 includes a portion of the first base substrate 111, the second pixel electrode PE21 disposed on the first base substrate 111, a portion of the second base substrate 112, and a portion of the common electrode CE, which is disposed on the portion of the second base substrate 112.

In exemplary embodiments, the green sub-pixel 20 and the blue sub-pixel 30 have the same structure and function as the red sub-pixel 10, except that the color filter substrate CF is a green color filter substrate or a blue color filter substrate, respectively.

In FIG. 3, the color filter substrate CF is disposed on the second substrate 115, however, the location of the color filter substrate CF is not limited thereto. For example, in exemplary embodiments, the color filter substrate CF may be disposed on the first substrate 114.

A cell gap CCG in the color filter area 11 is defined by a distance between the common electrode CE and the first pixel electrode PE11, and a cell gap OCG in the open area 12 is defined by a distance between the common electrode CE and the second pixel electrode PE21.

As shown in FIG. 3, since the open area 12 does not include the color filter substrate CF, the cell gap OCG of the open area 12 is larger than the cell gap CCG of the color filter area 11.

Figure 4:
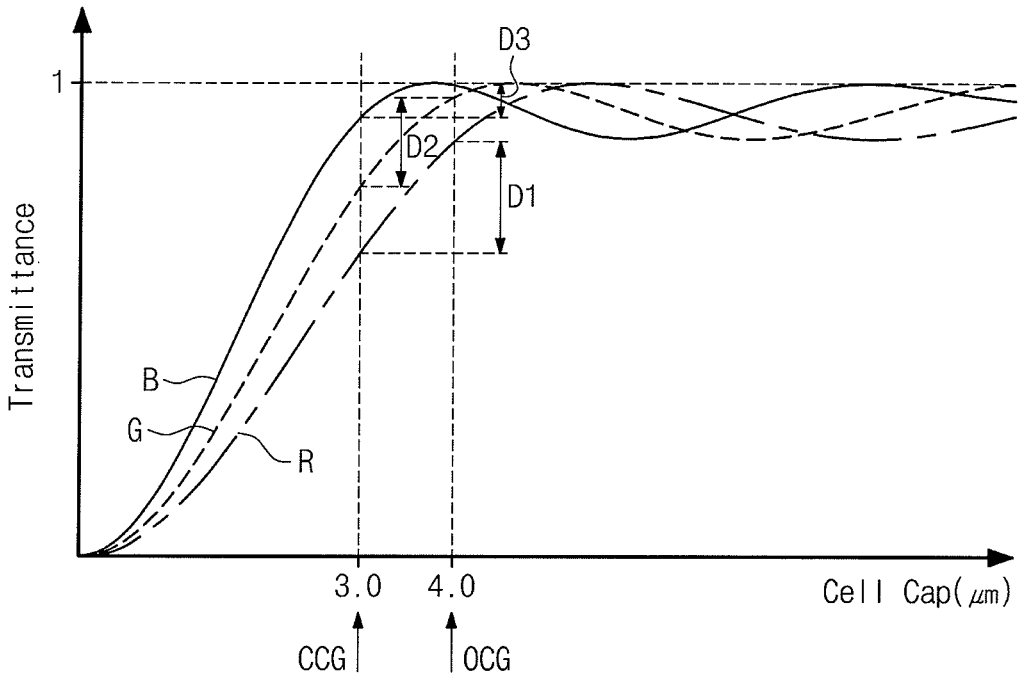
FIG. 4 is a graph showing a variation of the transmittance of red, green, and blue light according to an increase of a cell gap, according to an exemplary embodiment of the present invention.

FIG. 4 is a graph showing a variation of the transmittance of red, green, and blue light according to an increase of a cell gap, according to an exemplary embodiment of the present invention.

Referring to FIG. 4, the increase rates of the red, green, and blue light having different wavelengths from each other are different according to the increase of the cell gap. Since the cell gap of the color filter area is different from the cell gap of the open area, a difference between the increase rates of the light transmittance of the color filter area and the open area occurs.

For example, when the size of the cell gap CCG is increased from about three micrometers to about four micrometers, the increase rate D1 of the transmittance of the red light R passing through the open area is larger than the increase rate D2 of the transmittance of the green light G passing through the open area. In addition, the increase rate D2 of the transmittance of the green light G is larger than the increase rate D3 of the transmittance of the blue light B.

The transparent display apparatus according to exemplary embodiments of the present invention decreases the light transmittance of the open area of each sub-pixel to the level of the light transmittance of the color filter area of each sub-pixel.

For example, when the cell gap CCG of the color filter area is set to about three micrometers and the cell gap OCG of the open area is set to about four micrometers, the first down data signal is applied to the open area 12 of the red sub-pixel 10, and the light transmittance of the open area 12 of the red sub-pixel 10 is decreased by the increase rate D1 of the transmittance of the red light R. In addition, the second down data signal is applied to the open area 22 of the green sub-pixel 20, and the light transmittance of the open area 22 of the green sub-pixel 20 is decreased by the increase rate D2 of the transmittance of the green light G. Further, the third down data signal is applied to the open area 32 of the blue sub-pixel 30, and the light transmittance of the open area 32 of the blue sub-pixel 30 is decreased by the increase rate D3 of the transmittance of the blue light B.

Since the increase rate D1 of the transmittance of the red light R is the highest rate, the voltage level of the first down data signal is set to the lowest voltage level among the first, second, and third down data signals in order to substantially reduce the transmittance of the red light R relative to the green and blue lights G and B.

In addition, since the increase rate D3 of the transmittance of the blue light B is the lowest rate, the transmittance of the blue light B should be the least reduced. Accordingly, the voltage level of the third down data signal is set to the highest voltage level among the first, second, and third down data signals.

In addition, the increase rate D2 of the transmittance of the green light G is lower than the increase rate D1 of the transmittance of the red light R, and higher than the increase rate D3 of the blue light B. Thus, the second down data signal has a higher voltage level than the second down data signal, and a lower voltage level than the third down data signal.

As a result, the voltage level of the first down data signal is lower than the voltage level of the second down data signal, and the voltage level of the second down data signal is lower than the voltage level of the third down data signal. In addition, as shown in FIG. 4, the transmittance of the red, green, and blue lights are increased with different rates according to the size of the cell gap, and begin to oscillate. Thus, the ratio of the voltage levels of the first to third down data signals may be different according to the size of the cell gap.

Figure 5:
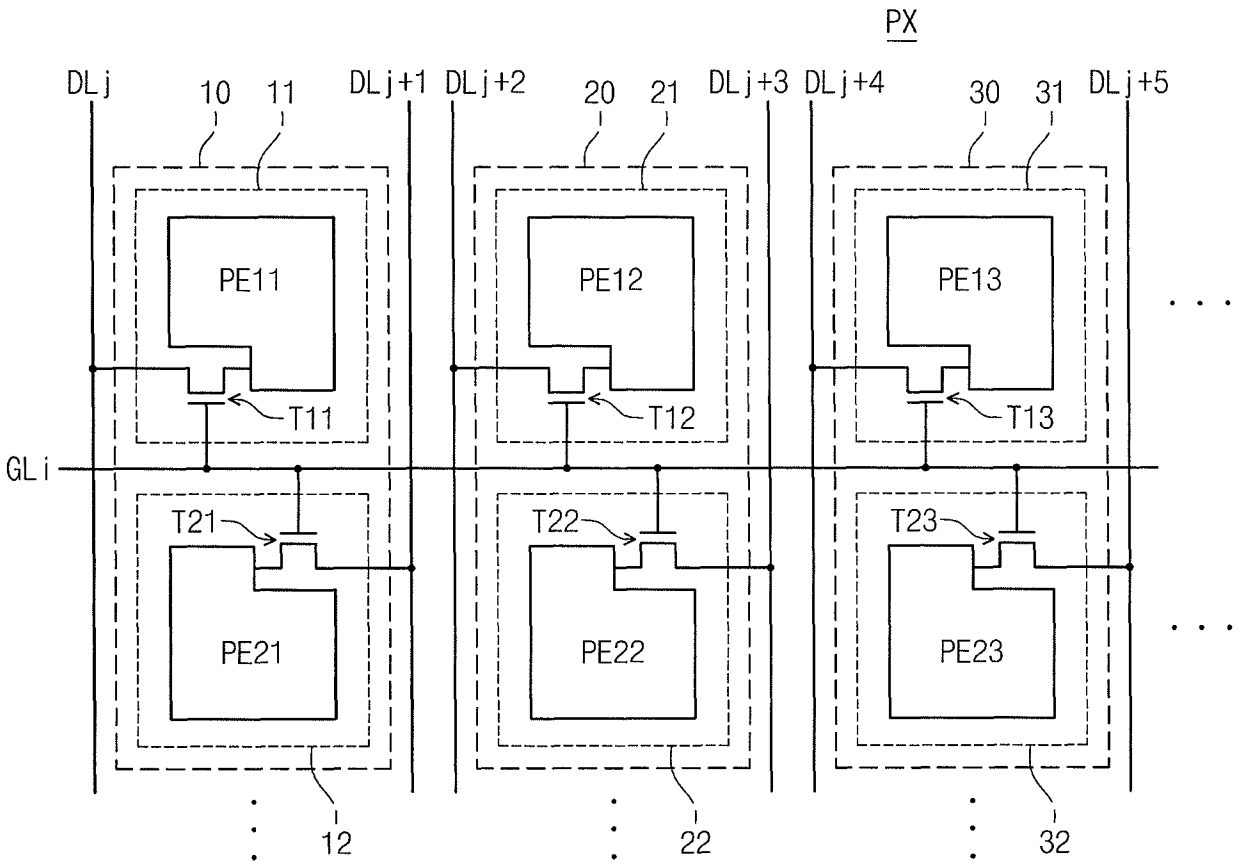
FIG. 5 is a view showing a configuration of the pixel shown in FIG. 2A, according to an exemplary embodiment of the present invention.

FIG. 5 is a view showing a configuration of the pixel shown in FIG. 2A, according to an exemplary embodiment of the present invention.

In FIG. 5, one sub-pixel is connected to one gate line and two data lines (e.g., a 1G2D configuration). Hereinafter, the first data lines will be referred to as odd-numbered data lines DLj, DLj+2, and DLj+4 and the second data lines will be referred to as even-numbered data lines DLj+1, DLj+3, and DLj+5.

Referring to FIG. 5, the pixel PX includes the red sub-pixel 10, the green sub-pixel 20, and the blue sub-pixel 30. The red, green, and blue sub-pixels 10, 20, and 30 include the color filter areas 11, 21, and 31 and the open areas 12, 22, and 32. Each of the color filter areas 11, 21, and 31 includes a corresponding one of first thin-film transistors T11, T12, and T13, and a corresponding one of first pixel electrodes PE11, PE12, and PE13. Each of the open areas 12, 22, and 32 includes a corresponding one of second thin-film transistors T21, T22, and T23 and a corresponding one of second pixel electrodes PE21, PE22, and PE23.

Each of the odd-numbered data lines DLj, DLj+2, and DLj+4 is connected to a corresponding color filter area of the color filter areas 11, 21, and 31 of the red, green, and blue sub-pixels 10, 20, and 30. Each of the even-numbered data lines DLj+1, DLj+3, and DLj+5 is connected to a corresponding open area of the open areas 12, 22, and 32 of the red, green, and blue sub-pixels 10, 20, and 30. However, the connection of the data lines is not limited to this configuration. For example, in an exemplary embodiment, the even-numbered data lines DLj+1, DLj+3, and DLj+5 may be connected to the color filter areas 11, 21, and 31, and the odd-numbered data lines DLj, DLj+2, and DLj+4 may be connected to the open areas 12, 22, and 32. In FIG. 5, j is a positive integer, and j+5 is less than or equal to m.

Source electrodes of the first thin-film transistors T11, T12, and T13 of the color filter areas 11, 21, and 31 are respectively connected to the odd-numbered data lines DLj, DLj+2, and DLj+4, drain electrodes of the first thin-film transistors T11, T12, and T13 of the color filter areas 11, 21, and 31 are respectively connected to the first pixel electrodes PE11, PE12, and PE13, and gate electrodes of the first thin-film transistors T11, T12, and T13 of the color filter areas 11, 21, and 31 are commonly connected to a gate line GLi. In FIG. 5, i is a positive integer less than or equal to n.

Source electrodes of the second thin-film transistors T21, T22, and T23 of the open areas 12, 22, and 32 are respectively connected to the even-numbered data lines DLj+1, DLj+3, and DLj+5, drain electrodes of the second thin-film transistors T21, T22, and T23 of the open areas 12, 22, and 32 are respectively connected to the second pixel electrodes PE21, PE22, and PE23, and gate electrodes of the second thin-film transistors T21, T22, and T23 of the open areas 12, 22, and 32 are commonly connected to the gate line GLi.

Hereinafter, it is assumed that the first sub-data signal and the first down data signal are applied to the red sub-pixel 10, the second sub-data signal and the second down data signal are applied to the green sub-pixel 20, and the third sub-data signal and the third down data signal are applied to the blue sub-pixel 30.

When the gate signal is applied to the first thin-film transistors T11, T12, and T13 and the second thin-film transistors T21, T22, and T23 through the gate line GLi, the first thin-film transistors T11, T12, and T13 and the second thin-film transistors T21, T22, and T23 are turned on. Accordingly, the first, second, and third sub-data signals are respectively applied to the first pixel electrodes PE11, PE12, and PE13 of the color filter areas 11, 21, and 31 through the odd-numbered data lines DLj, DLj+2, and DLj+4, and the first, second, and third down data signals are respectively applied to the second pixel electrodes PE21, PE22, and PE23 of the open areas 12, 22, and 32 through the even-numbered data lines DLj+1, DLj+3, and DLj+5.

Hereinafter, an operation of the transparent display apparatus will be described under the condition that the cell gap CCG of the color filter area is about three micrometers and the cell gap OCG of the open area is about four micrometers.

As described above, the first down data signal has a lower voltage level than that of the first sub-data signal, the second down data signal has a lower voltage level than that of the second sub-data signal, and the third down data signal has a lower voltage level than that of the third sub-data signal. In addition, the first, second, and third down data signals have different voltage levels from each other, the voltage level of the first down data signal is lower than the voltage level of the second down data signal, and the voltage level of the second down data signal is lower than the voltage level of the third down data signal.

The first sub-data signal is applied to the color filter area 11 of the red sub-pixel 10, and the first down data signal is applied to the open area 12 of the red sub-pixel 10. Accordingly, as described with reference to FIG. 4, the light transmittance of the open area 12 of the red sub-pixel 10 is lowered by the increase rate D1 of the transmittanceof the red light R.

The second sub-data signal is applied to the color filter area 21 of the green sub-pixel 20, and the second down data signal is applied to the open area 22 of the green sub-pixel 20. Accordingly, as described with reference to FIG. 4, the light transmittance of the open area 22 of the green sub-pixel 20 is lowered by the increase rate D2 of the transmittance of the green light G.

The third sub-data signal is applied to the color filter area 31 of the blue sub-pixel 30, and the third down data signal is applied to the open area 32 of the blue sub-pixel 30. Accordingly, as described with reference to FIG. 4, the light transmittance of the open area 32 of the blue sub-pixel 30 is lowered by the increase rate D3 of the transmittance of the blue light 13.

In the exemplary embodiment described above, the ratio of the voltage levels of the first to third down data signals has been described when the size of the cell gap OCG of the open area is about four micrometers, however the ratio of the voltage levels of the first to third down data signals may be varied according to the size of the cell gap OCG of the open area.

As a result, the transparent display apparatus 100 according to an exemplary embodiment may reduce the difference between the light transmittance of the color filter areas 11, 21, and 31 of the red, green, and blue sub-pixels 10, 20, and 30, and the light transmittance of the open areas 12, 22, and 32 of the red, green, and blue sub-pixels 10, 20, and 30, which may reduce or prevent display defects such as, for example, a yellowish discoloration.

Figure 6:
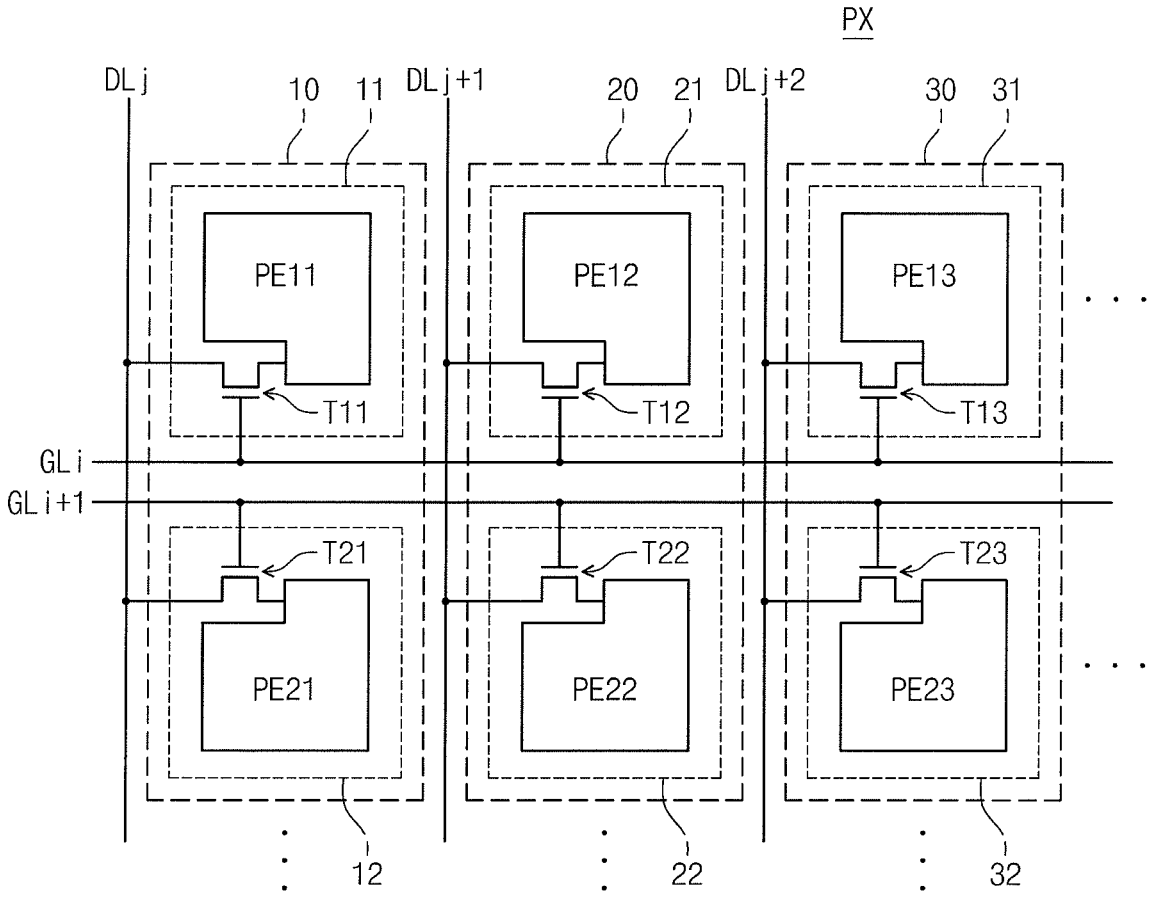
FIG. 6 is a view showing a configuration of a pixel of a transparent display apparatus, according to an exemplary embodiment of the present invention.

FIG. 6 is a view showing a configuration of a pixel of a transparent display apparatus, according to an exemplary embodiment of the present invention.

In FIG. 6, one sub-pixel is connected to two gate lines and one data line (e.g., a 2G1D configuration). The pixel PX shown in FIG. 6 has the same configuration as the pixel PX shown in FIG. 5, except for the connections between the sub-pixels and the gate and data lines.

Referring to FIG. 6, the gate lines are grouped into a plurality of pairs, each pair including two gate lines GLi and GLi+1. The two gate lines GLi and GLi+1 are connected to the sub-pixels arranged in corresponding rows. The data lines DLj, DLj+1, and DLj+2 are insulated from the gate lines and connected to the sub-pixels arranged in corresponding columns. Hereinafter, one gate line of the two gate lines GLi and GLi+1 is referred to as a first gate line GLi, and the other gate line of the two gate lines GLi and GLi+1 is referred to as a second gate line GLi+1. In FIG. 6, j is a positive integer and j+2 is less than or equal to m. In addition, i is a positive integer and i+1 is less than or equal to n.

The first gate line GLi (e.g., a gate line of a current stage) is connected to the color filter areas 11, 21, and 31 of the red, green, and blue sub-pixels 10, 20, and 30 arranged in the corresponding row. The second gate line GLi+1 (e.g., a gate line of a next stage) is connected to the open areas 12, 22, and 32 of the red, green, and blue sub-pixels 10, 20, and 30 arranged in the corresponding row.

Each of the data lines DLj, DLj+1, and DLj+2 is connected to a corresponding color filter area of the color filter areas 11, 21, and 31 of the red, green, and blue sub-pixels 10, 20, and 30 and a corresponding open area of the open areas 12, 22, and 32 of the red, green, and blue sub-pixels 10, 20, and 30.

Source electrodes of the first thin-film transistors T11, T12, and T13 of the color filter areas 11, 21, and 31 are respectively connected to the data lines DLj, DLj+1, and DLj+2, drain electrodes of the first thin-film transistors T11, T12, and T13 of the color filter areas 11, 21, and 31 are respectively connected to the first pixel electrodes PE11, PE12, and PE13, and gate electrodes of the first thin-film transistors T11, T12, and T13 of the color filter areas 11, 21, and 31 are commonly connected to the first gate line GLi.

Source electrodes of the second thin-film transistors T21, T22, and T23 of the open areas 12, 22, and 32 are respectively connected to the data lines DLj, DLj+1, and DLj+2, drain electrodes of the second thin-film transistors T21, T22, and T23 of the open areas 12, 22, and 32 are respectively connected to the second pixel electrodes PE21, PE22, and PE23, and gate electrodes of the second thin-film transistors T21, T22, and T23 of the open areas 12, 22, and 32 are commonly connected to the second gate line GLi+1.

When the gate signal is sequentially applied to the gate lines, the gate signal is applied to the first thin-film transistors T11, T12, and T13 through the first gate line GLi and then applied to the second thin-film transistors T21, T22, and T23 through the second gate line GLi+1. When the gate signal is applied to the first thin-film transistors T11, T12, and T13 through the first gate line GLi, the first thin film-transistors T11, T12, and T13 are turned on. Thus, the first, second, and third sub-data signals are respectively applied to the first pixel electrodes PE11, PE12, and PE13 of the color filter areas 11, 21, and 31 through the data lines DLj, DLj+1, and DLj+2.

When the gate signal is applied to the second thin-film transistors T21, T22, and T23 through the second gate line GLi+1, the second thin-film transistors T21, T22, and T23 are turned on. Thus, the first, second, and third down data signals are respectively applied to the second pixel electrodes PE21, PE22, and PE23 of the open areas 12, 22, and 32 through the data lines DLj, DLj+1, and DLj+2.

As a result, the transparent display apparatus may reduce the difference between the light transmittance of the color filter areas 11, 21, and 31 of the red, green, and blue sub-pixels 10, 20, and 30 and the light transmittance of the open areas 12, 22, and 32 of the red, green, and blue sub-pixels 10, 20, and 30, and may reduce or prevent display defects such as, for example, a yellowish discoloration.

Figure 7:
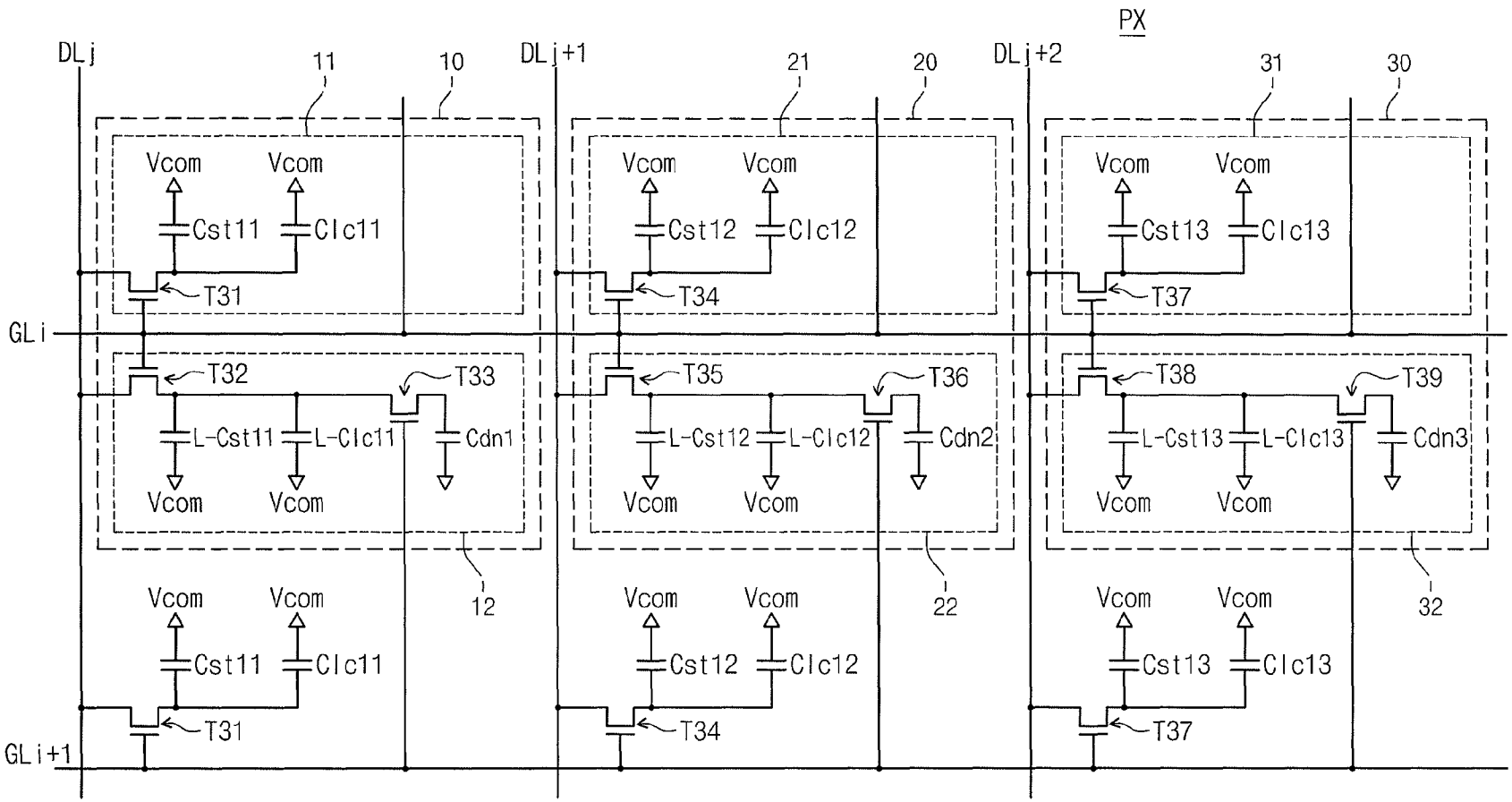
FIGS. 7 and 8 are equivalent circuit diagrams showing a pixel of a transparent display apparatus, according to an exemplary embodiment of the present invention.
Figure 8:
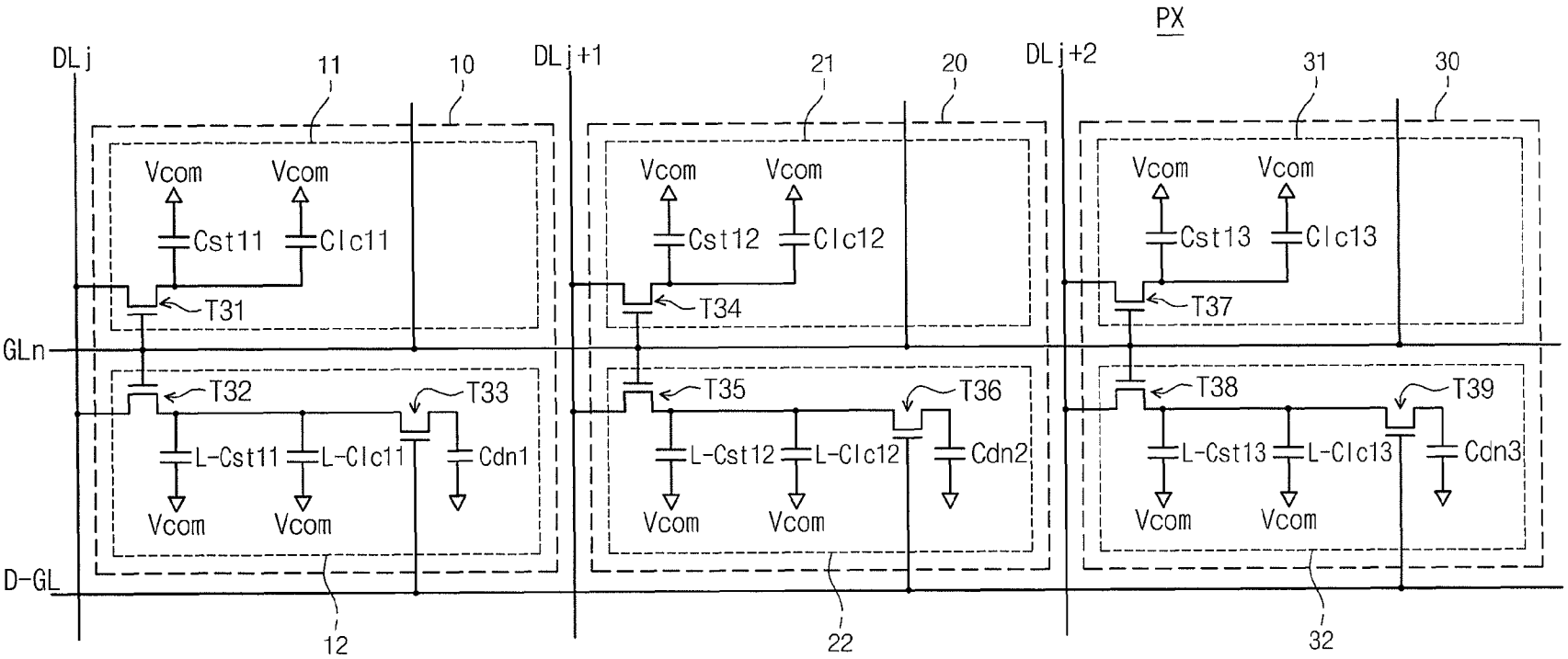
Figure 9:
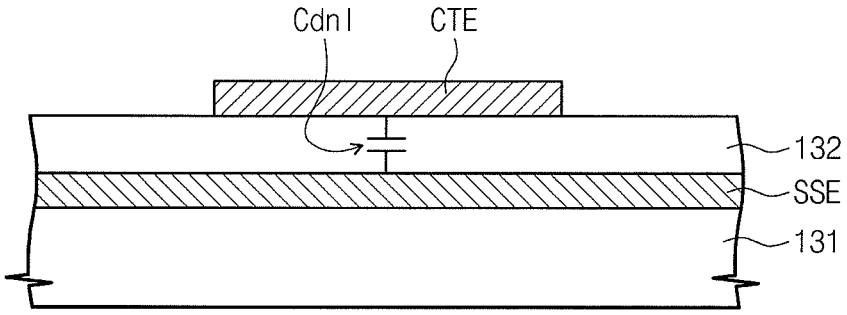
FIG. 9 is a cross-sectional view showing the down capacitor shown in FIGS. 7 and 8, according to an exemplary embodiment of the present invention.

FIGS. 7 and 8 are equivalent circuit diagrams showing a pixel of a transparent display apparatus, according to an exemplary embodiment of the present invention. FIG. 9 is a cross-sectional view showing the down capacitor shown in FIGS. 7 and 8.

The transparent display apparatus according to the exemplary embodiment shown in FIGS. 7 to 9 includes the gate lines to which the gate signal is sequentially applied, and the data lines to which the data signals including the first, second, and third sub-data signals are applied. The first sub-data signal is applied to the red sub-pixel, the second sub-data signal is applied to the green sub-pixel, and the third sub-data signal is applied to the blue sub-pixel.

Referring to FIG. 7, each pixel PX includes the red sub-pixel 10, the green sub-pixel 20, and the blue sub-pixel 30. The red, green, and blue sub-pixels 10, 20, and 30 are connected to the data lines DLj, DLj+1, and DLj+2, respectively, and commonly connected to the corresponding gate line GLi. In FIGS. 7 and 8, j is a positive integer and j+2 is less than or equal to m. In addition, i is a positive integer less than or equal to n.

Each of the red, green, and blue sub-pixels 10, 20, and 30 includes a corresponding color filter area of the color filter areas 11, 21, and 31 and a corresponding open area of the open areas 12, 22, and 32. Each of the color filter areas 11, 21, and 31 includes a corresponding first thin-film transistor of first thin-film transistors T31, T34, and T37, a corresponding first storage capacitor of first storage capacitors Cst11, Cst12, and Cst13, and a corresponding first liquid crystal capacitor of first liquid crystal capacitors Clc11, Clc12, and Clc13. Each of the open areas 12, 22, and 32 includes a corresponding second thin-film transistor of second thin-film transistors T32, T35, and T38, a corresponding second storage capacitor of second storage capacitors L-Cst11, L-Cst12, and L-Cst13, a corresponding second liquid crystal capacitor of second liquid crystal capacitors L-Clc11, L-Clc12, and L-Clc13, a corresponding third thin-film transistor of third thin-film transistors T33, T36, and T39, and a corresponding down capacitor of down capacitors Cdn1, Cdn2, and Cdn3. The third thin-film transistors T33, T36, and T39 and the down capacitors Cdn1, Cdn2, and Cdn3 of the red, green, and blue sub-pixels 10, 20, and 30 form level down parts, respectively.

In FIGS. 7 and 8, the red, green, and blue sub-pixels 10, 20, and 30 have the same configuration as each other, except that the down capacitors Cdn1, Cdn2, and Cdn3 have different capacitances from each other. Accordingly, the configuration of the red sub-pixel 10 will be primarily described below, and only the differences in the configurations of the green and blue sub-pixels 20 and 30 will be described in further detail. Hereinafter, the down capacitor Cdn1 of the red sub-pixel 10 will be referred to as a first down capacitor Cdn1, the down capacitor Cdn2 of the green sub-pixel 20 will be referred to as a second down capacitor Cdn2, and the down capacitor Cdn3 of the blue sub-pixel 30 will be referred to as a third down capacitor Cdn3.

In the first thin-film transistor T31 of the color filter area 11 of the red sub-pixel 10, the source electrode is connected to the corresponding data line DLj, the drain electrode is connected to the first storage capacitor Cst11 and the first liquid crystal capacitor Clc11, and the gate electrode is connected to the corresponding i-th gate line GLi (e.g., a gate line of a current stage).

The first liquid crystal capacitor Clc11 may be formed by the first pixel electrode, as described with reference to FIGS. 3 and 5, which is connected to the drain electrode of the first thin-film transistor T31, the common electrode facing the first pixel electrode, and the liquid crystal layer interposed between the first pixel electrode and the common electrode. In addition, the first storage capacitor Cst11 may be formed by the first pixel electrode, the storage electrode, and the insulating layer interposed between the first pixel electrode and the storage electrode.

In the second thin-film transistor T32 of the open area 12 of the red sub-pixel 10, the source electrode is connected to the corresponding data line DLj, the drain electrode is connected to the second storage capacitor L-Cst11 and the second liquid crystal capacitor L-Clc11, and the gate electrode is connected to an (i+1)th gate line GLi+1 (e.g., a gate line of a next stage) following the i-th gate line GLi.

The second liquid crystal capacitor L-Clc11 may be formed by the second pixel electrode, as described with reference to FIGS. 3 and 5, which is connected to the drain electrode of the second thin-film transistor T32, the common electrode facing the second pixel electrode, and the liquid crystal layer interposed between the second pixel electrode and the common electrode. In addition, the second storage capacitor L-Cst11 may be formed by the second pixel electrode, the storage electrode, and the insulating layer interposed between the second pixel electrode and the storage electrode.

Referring to FIG. 9, the first down capacitor Cdn1 is defined by a storage electrode SSE disposed on a base substrate 131, an opposite electrode CTE extended from the source electrode of the third thin-film transistor T33 and overlapped with the storage electrode SSE, and an insulating layer 132 interposed between the opposite electrode CTE and the storage electrode SSE. In an exemplary embodiment, the first down capacitor Cdn1 may include the second pixel electrode instead of the storage electrode SSE. The second and third down capacitors Cdn2 and Cdn3 may have the same structure as the first down capacitor Cdn1.

Referring to FIG. 7, in the third thin-film transistor T33 of the open area 12 of the red sub-pixel 10, the source electrode is connected to the first down capacitor Cdn1, the drain electrode is connected to the second storage capacitor L-Cst11 and the second liquid crystal capacitor L-Clc11, and the gate electrode is connected to the (i+1)th gate line GLi+1.

When the gate signal is applied to the first thin-film transistor T31 of the color filter area 11 and the second thin-film transistor T32 of the open area 12 through the i-th gate line GLi, the first thin-film transistor T31 and the second thin-film transistor T32 are turned on. The first sub-data signal is applied to the first and second pixel electrodes of the first and second liquid crystal capacitor Clc11 and L-Clc11 through the turned-on first and second thin-film transistors T31 and T32. Accordingly, the first and second liquid crystal capacitors Clc11 and L-Clc11 are respectively charged with first and second pixel voltages having the same voltage level.

When the gate signal is applied to the third thin-film transistor T33 of the open area 12 through the (i+1)th gate line GLi+1, the third thin-film transistor T33 is turned on. The second liquid crystal capacitor L-Clc11 and the first down capacitor Cdn1 are electrically connected to each other by the turned-on third thin-film transistor T33. Thus, the second liquid crystal capacitor L-Clc11 and the first down capacitor Cdn1 share the charge in response to the gate signal provided through the (i+1)th gate line GLi+1.

The first down capacitor Cdn1 is charged with a previous pixel voltage by the first sub-data signal during a previous frame. Since a polarity of the data signal is inverted every one frame, the previous pixel voltage charged in the first down capacitor Cdn1 has a polarity opposite to that of the first and second pixel voltages. Accordingly, the second pixel voltage charged in the second liquid crystal capacitor L-Clc11 by the third thin-film transistor T33 is level-shifted down by the previous pixel voltage charged in the first down capacitor Cdn1.

Thus, the first pixel voltage corresponding to the first sub-data signal is charged in the color filter area 11 of the red sub-pixel 10, and the second pixel voltage corresponding to a voltage lower than the first pixel voltage is charged in the open area 12 of the red sub-pixel 10. That is, the second pixel voltage corresponds to a voltage having a voltage level lower than that of the first sub-data signal.

In FIG. 7, The green sub-pixel 20 and the blue sub-pixel 30 have the same configuration as the red sub-pixel 10 and are operated in a similar manner as the red sub-pixel 10. Accordingly, the second pixel voltages charged in the open areas 22 and 32 of the green sub-pixel 20 and the blue sub-pixel 30 are level-shifted down by the previous pixel voltages charged in the second and third down capacitors Cdn2 and Cdn3, respectively. Thus, the second pixel voltages charged in the open areas 22 and 32 correspond to voltages having a lower voltage level than those of the second and third sub-data signals, respectively.

The voltage charged in the capacitor may be controlled by adjusting the size of the capacitor. Accordingly, referring to FIGS. 4 and 7, a size of the first down capacitor Cdn1 of the open area 12 of the red sub-pixel 10 is set to a value that will decrease the light transmittance of the open area 12 by the increase rate D1 of the transmittance of the red light R. A size of the second down capacitor Cdn2 of the open area 22 of the green sub-pixel 20 is set to a value that will decrease the light transmittance of the open area 22 by the increase rate D2 of the transmittance of the green light G. A size of the third down capacitor Cdn3 of the open area 32 of the blue sub-pixel 30 is set to a value that will decrease the light transmittance of the open area 32 by the increase rate D3 of the transmittance of the blue light B.

Since the increase rate D1 of the transmittance of the blue light B is the smallest rate, the transmittance of the blue light B is reduced relatively less than the transmittance of the red light R and the green light G. Thus, among the second pixel voltages charged in the open areas 12, 22, and 32, the second pixel voltage charged in the open area 32 of the blue sub-pixel 30 should be reduced relatively less than the second pixel voltages charged in the open areas 12 and 22. As a result, the third down capacitor Cdn3 is set to have the smallest size among the first, second, and third down capacitors Cdn1, Cdn2, and Cdn3.

The increase rate D2 of the transmittance of the green light G is lower than the increase rate D1 of the transmittance of the red light R, and higher than the increase rate D3 of the transmittance of the blue light B. Therefore, the level of the second pixel voltage of the open area 22 of the green sub-pixel 20 is relatively slightly reduced compared to the level of the second pixel voltage of the open area 12 of the red sub-pixel 10, and relatively considerably reduced compared to the level of the second pixel voltage of the open area 32 of the blue sub-pixel 30. As a result, the second down capacitor Cdn2 has a smaller size than that of the first down capacitor Cdn1 and a larger size than that of the third down capacitor Cdn3.

Thus, the first down capacitor Cdn1 of the open area 12 of the red sub-pixel 10 has a larger size than that of the second down capacitor Cdn2 of the open area 22 of the green sub-pixel 20. The second down capacitor Cdn2 of the open area 22 of the green sub-pixel 20 has a larger size than that of the third down capacitor Cdn3 of the open area 32 of the blue sub-pixel 30.

As a result of the above-mentioned configuration, the light transmittance of the open areas 12, 22, and 32 of the red, green, and blue sub-pixels 10, 20, and 30 is lowered to substantially match the light transmittance of the color filter areas 11, 21, and 31 of the red, green, and blue sub-pixels 10, 20, and 30, and a difference between the light transmittance of the open areas 12, 22, and 32 and the light transmittance of the color filter areas 11, 21, and 31 may be reduced.

As described above, the light transmittance depends on the size of the cell gap. Accordingly, the ratio of the sizes of the first to third down capacitors may be set differently according to the size of the cell gap.

Referring to FIG. 8, the transparent display apparatus according to an exemplary embodiment includes a dummy gate line D-GL disposed after the last gate line GLn. The dummy gate line D-GL is connected to the gate electrode of the third thin-film transistor T33 of the open area 12 connected to the last gate line GLn.

If the dummy gate line D-GL is not included, the gate signal is not applied to the gate electrode of the third thin-film transistor T33 of the open area 12 connected to the last gate line GLn. Inclusion of the dummy gate line D-GL results in the application of the gate signal to the gate electrode of the third thin-film transistor T33 of the open area 12, which is connected to the last gate line GLn, through the dummy gate line D-GL. As a result, the level down part of the open area 12 connected to the last gate line GLn is operated.

The transparent display apparatus according to the exemplary embodiment described above with reference to FIGS. 7 to 9 may reduce the difference between the light transmittance of the color filter areas of the red, green, and blue sub-pixels and the light transmittance of the open areas of the red, green, and blue sub-pixels, which may reduce or prevent display defect such as, for example, a yellowish discoloration.

Figure 10:
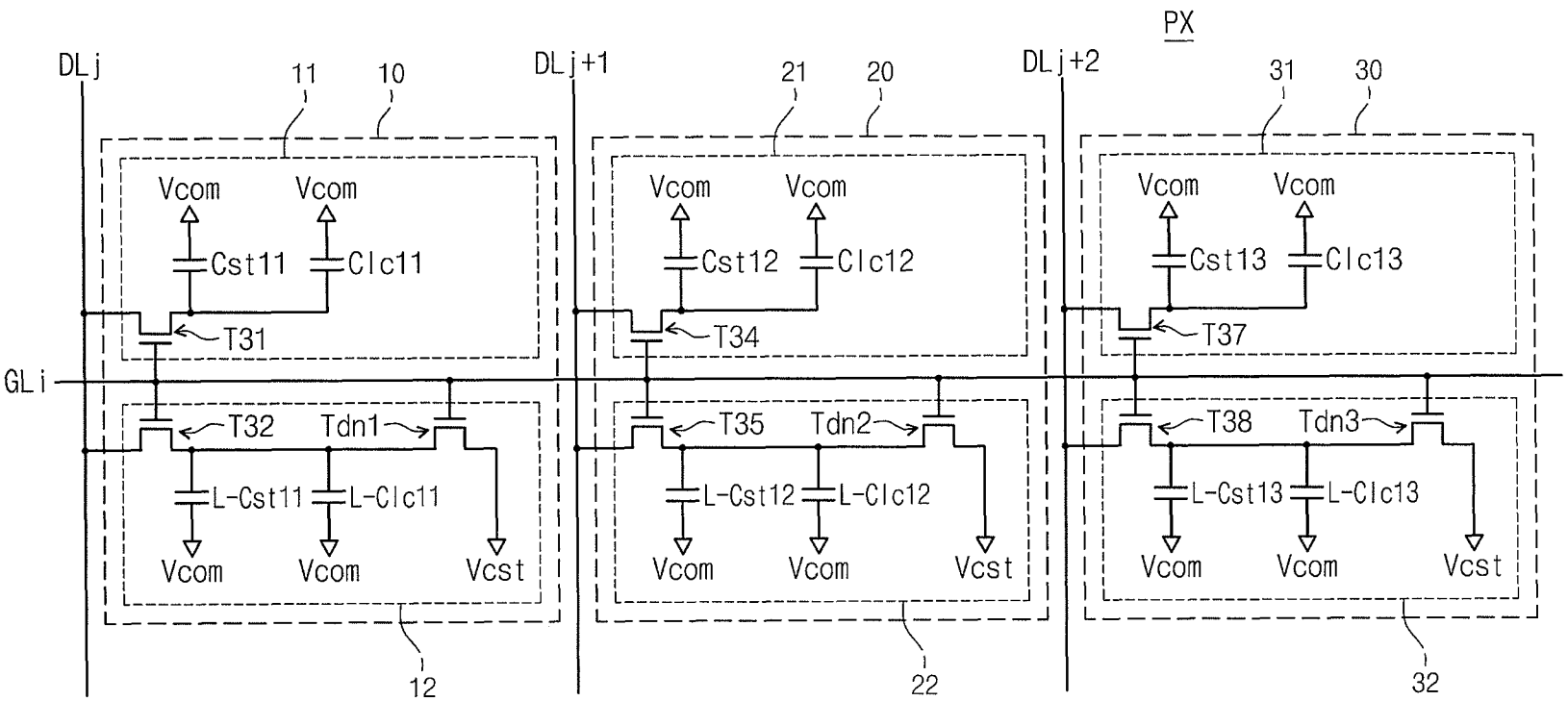
FIG. 10 is an equivalent circuit diagram showing a pixel of a transparent display apparatus, according to an exemplary embodiment of the present invention.
Figure 11:
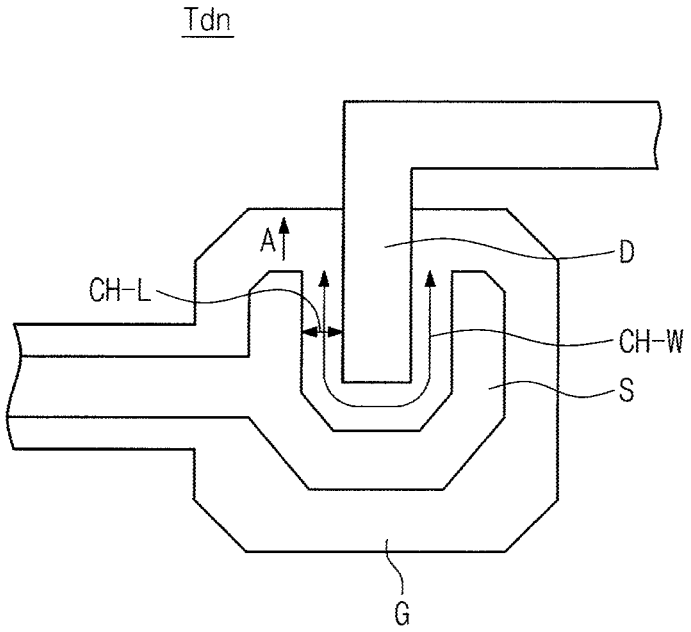
FIG. 11 is a view showing the down thin-film transistor shown in FIG. 10, according to an exemplary embodiment of the present invention.

FIG. 10 is an equivalent circuit diagram showing a pixel of a transparent display apparatus, according to an exemplary embodiment of the present invention. FIG. 11 is a view showing the down thin-film transistor shown in FIG. 10, according to an exemplary embodiment of the present invention.

The transparent display apparatus according to the exemplary embodiment shown in FIGS. 10 and 11 includes the gate lines to which the gate signal is sequentially applied and the data lines to which the data signals including first, second, and third sub-data signals are applied. The first sub-data signal is applied to the red sub-pixel, the second sub-data signal is applied to the green sub-pixel, and the third sub-data signal is applied to the blue sub-pixel.

The pixel PX shown in FIG. 10 includes a down transistor instead of the third thin-film transistor and the down capacitor that form the level down part of the pixel shown in FIG. 7. Except for the above-mentioned down transistor, the pixel PX shown in FIG. 10 has the same configuration as the pixel PX shown in FIG. 7.

Referring to FIG. 10, the open area 12 of the red sub-pixel 10 includes a first down thin-film transistor Tdn1. The open area 22 of the green sub-pixel 20 includes a second down thin-film transistor Tdn2. The open area 32 of the blue sub-pixel 30 includes a third down thin-film transistor Tdn3.

Source electrodes of the first, second, and third down thin-film transistors Tdn1, Tdn2, and Tdn3 of the red, green, and blue sub-pixels 10, 20, and 30 are connected to a storage voltage terminal Vcst, and each of drain electrodes of the first, second, and third down thin-film transistors Tdn1, Tdn2, and Tdn3 of the red, green, and blue sub-pixels 10, 20, and 30 is connected to a corresponding one of second storage capacitors L-Cst11, L-Cst12, and L-Cst13 and a corresponding one of second liquid crystal capacitors L-Clc11, L-Clc12, and L-Clc13. In addition, gate electrodes of the first, second, and third down thin-film transistors Tdn1, Tdn2, and Tdn3 of the red, green, and blue sub-pixels 10, 20, and 30 are commonly connected to the gate line GLi. Each of the first, second, and third down thin-film transistors Tdn1, Tdn2, and Tdn3 forms a level down part.

In FIG. 10, except for the first, second, and third down thin-film transistors Tdn1, Tdn2, and Tdn3 having different channel sizes from each other in exemplary embodiments, the red, green, and blue sub-pixels 10, 20, and 30 have the same configuration. Accordingly, the red sub-pixel 10 will be primarily described below, and only the differences in the configurations of the green and blue sub-pixels 20 and 30 will be described in further detail.

When the gate signal is applied to the first thin-film transistor T31 of the color filter area 11, the second thin-film transistor T32 of the open area 12, and the first down thin-film transistor Tdn1 of the open area 12 through the gate line GLi, the first thin-film transistor T31, the second thin-film transistor T32, and the first down thin-film transistor Tdn1 are turned on.

The first sub-data signal is applied to the first pixel voltage of the first liquid crystal capacitor Clc11 through the turned-on first thin-film transistor T31. Accordingly, the first liquid crystal capacitor Clc11 is charged with the first pixel voltage corresponding to the first sub-data signal.

The first sub-data signal is applied to the open area 12 through the turned-on second thin-film transistor T32, and the storage voltage Vcst is applied to the open area 12 through the turned-on first down thin-film transistor Tdn1.

A range of the voltage level of the first sub-data signal is set wider than a range of the voltage level of the storage voltage Vcst. For example, when the voltage level of the first sub-data signal is in the range of about 1 volt to about 15 volts, the voltage level of the storage voltage Vcst may be in the range of about 3 volts to about 13 volts. In this case, the first sub-data signal and the storage voltage Vcst are applied to the open area 12 such that an absolute value of the difference between the voltage level of the first sub-data signal and the voltage level of the common voltage Vcom becomes larger than an absolute value of the difference between the voltage level of the storage voltage Vcst and the voltage level of the common voltage Vcom.

When the second thin-film transistor T32 and the first down thin-film transistor Tdn1 are turned on, a voltage at a contact point between the second thin-film transistor T32 and the first down thin-film transistor Tdn1 corresponds to a voltage that is obtained by voltage division using resistance when the second thin-film transistor T32 and the first down thin-film transistor Tdn1 are turned on. That is, the voltage at the contact point between the second thin-film transistor T32 and the first down thin-film transistor Tdn1 has a voltage level corresponding to an intermediate level between the first sub-data signal provided through the turned-on second thin-film transistor T32 and the storage voltage Vcst provided through the turned-on first down thin-film transistor Tdn1.

For example, when the first sub-data signal, the storage voltage Vcst, and the common voltage Vcom are about 14 volts, about 12 volts, and about 7 volts, respectively, the voltage at the contact point between the second thin-film transistor T32 and the first down thin-film transistor Tdn1 may be about 13 volts. In this case, since the voltage of about 13 volts is applied to the second pixel electrode of the second liquid crystal capacitor L-Clc11 and the common voltage Vcom is about 7 volts, the second liquid crystal capacitor L-Clc11 is charged with a voltage of about 6 volts,which is obtained by subtracting the voltage of about 7 volts from the voltage of about 13 volts. If the first down thin-film transistor Tdn1 is not included, the second liquid crystal capacitor L-Clc11 will be charged with a voltage of about 7 volts obtained by subtracting the voltage of about 7 volts from the voltage of about 14 volts, since the first sub-data signal of about 14 volts is applied to the second pixel electrode of the second liquid crystal capacitor L-Clc11. Accordingly, the absolute value of the voltage charged in the second liquid crystal capacitor L-Clc11 becomes lower as a result of the storage voltage Vcst applied through the turned-on first down thin-film transistor Tdn1.

The voltage level of the first sub-data signal and the storage voltage Vcst may be lower than that of the common voltage Vcom. For example, when the voltage level of the first sub-data signal is about 1 volt and the voltage level of the storage voltage Vcst is about 3 volts, the voltage at the contact point between the second thin-film transistor T32 and the first down thin-film transistor Tdn1 may be about 2 volts. In this case, since the second liquid crystal capacitor L-Clc11 is applied with the voltage of about 2 volts and the common voltage Vcom is about 7 volts, the second liquid crystal capacitor L-Clc11 is charged with a voltage of about 5 volts, which is obtained by subtracting the voltage of about 2 volts from the voltage of about 7 volts. If the first down thin-film transistor Tdn1 is not included, the second liquid crystal capacitor L-Clc11 is charged with a voltage of about 6 volts, which is obtained by subtracting a voltage of about 1 volt from the voltage of about 7 volts, since the first sub-data signal of about 1 volt is applied to the second pixel electrode of the second liquid crystal capacitor L-Clc11. Accordingly, the absolute value of the voltage charged in the second liquid crystal capacitor L-Clc11 becomes lower as a result of the storage voltage Vcst applied through the turned-on first down thin-film transistor Tdn1. Hereinafter, the absolute value of the voltage is referred to as a voltage level.

As a result, the first liquid crystal capacitor Clc11 is charged with the first pixel voltage corresponding to the first sub-data signal, and the second liquid crystal capacitor L-Clc11 is charged with the second pixel voltage having a voltage level lower than the absolute value of the first pixel voltage.

The green sub-pixel 20 and the blue sub-pixel 30 may have the same configuration as the red sub-pixel 10, and are operated in a similar manner as the red sub-pixel 10. Thus, the second liquid crystal capacitors L-Clc12 and L-Clc13 of the green and blue sub-pixels 20 and 30 are charged with the second pixel voltage having a voltage level lower than the absolute value of the first pixel voltage.

The ratio of the voltage levels of the second pixel voltages may be controlled by adjusting the channel size of the down thin-film transistor.

FIG. 11 is a view showing the down thin-film transistor shown in FIG. 10, according to an exemplary embodiment of the present invention.

Referring to FIG. 11, a distance between a source electrode S and a drain electrode D of the down thin-film transistor is defined as a channel length CH-L, and a width between the source electrode S and the drain electrode D is defined as a channel width CH-W. When the source electrode S is elongated in a direction "A", the channel width CH-W is increased, and the channel width CH-W is decreased when the source electrode S is reduced in a direction opposite to the direction "A".

When the channel width CH-W is increased, an amount of current flowing from the source electrode S of the down thin-film transistor Tdn to the drain electrode D of the down thin-film transistor Tdn is increased and the resistance is decreased. Accordingly, referring to FIG. 10, the voltage at the contact point between the second thin-film transistor T32 and the first down thin-film transistor Tdn1 is decreased, and thus, the voltage level of the second pixel voltage is relatively considerably reduced. When the channel width CH-W is decreased, the amount of the current flowing from the source electrode S of the down thin-film transistor Tdn to the drain electrode D of the down thin-film transistor Tdn is decreased and the resistance is increased. As a result, the voltage at the contact point between the second thin-film transistor T32 and the first down thin-film transistor Tdn1 is increased, and the voltage level of the second pixel voltage is relatively slightly reduced.

When the channel length CH-L is increased, the amount of the current flowing from the source electrode S to the drain electrode D of the down thin-film transistor Tdn is decreased and the resistance is increased. When the channel length CH-L is decreased, the amount of the current flowing from the source electrode S to the drain electrode D of the down thin-film transistor Tdn is increased and the resistance is decreased. Thus, the voltage level of the second pixel voltage may be controlled by adjusting the channel length CH-L.

Hereinafter, a method of determining the size of the down thin-film transistor Tdn by adjusting the channel width CH-W will be described.

As described with reference to FIG. 4, the first down thin-film transistor Tdn1 of the open area 12 of the red sub-pixel 10 has a size designed to reduce the light transmittance of the open area 12 by the increase rate D1 of the transmittance of the red light R. The second down thin-film transistor Tdn2 of the open area 22 of the green sub-pixel 20 has a size designed to reduce the light transmittance of the open area 22 by the increase rate D2 of the transmittance of the green light G. The third down thin-film transistor Tdn3 of the open area 32 of the blue sub-pixel 30 has a size designed to reduce the light transmittance of the open area 32 by the increase rate D3 of the transmittance of the blue light B.

Since the increase rate D1 of the transmittance of the red light R is the highest rate, the transmittance of the red light R should be relatively considerably reduced. Accordingly, among the second pixel voltages charged in the open areas 12, 22, and 32, the voltage level of the second pixel voltage charged in the open area 12 of the red sub-pixel 10 is relatively considerably reduced. As a result, the size of the first down thin-film transistor Tdn1 is set to the largest size among the first, second, and third down thin-film transistors Tdn1, Tdn2, and Tdn3.

Since the increase rate D3 of the transmittance of the blue light B is the smallest rate, the transmittance of the blue light B should be the least reduced. Accordingly, among the second pixel voltages charged in the open areas 12, 22, and 32, the voltage level of the second pixel voltage charged in the open area 32 of the blue sub-pixel 30 should be relatively slightly reduced. As a result, the size of the third down thin-film transistor Tdn3 is set to the smallest size among the first, second, and third down thin-film transistors Tdn1, Tdn2, and Tdn3.

The increase rate D2 of the transmittance of the green light G is lower than the increase rate D1 of the transmittance of the red light R and higher than the increase rate D3 of the transmittance of the blue light B. Thus, the voltage level of the second pixel voltage of the open area 22 of the green sub-pixel 20 is relatively slightly reduced compared to the voltage level of the second pixel voltage of the open area 12 of the red sub-pixel 10, and relatively considerably reduced compared to the voltage level of the second pixel voltage of the open area 32 of the blue sub-pixel 30. As a result, the second down thin-film transistor Tdn2 is set to be smaller than that of the first down thin-film transistor Tdn1 and larger than that of the third down thin-film transistor Tdn3.

Thus, the first down thin-film transistor Tdn1 of the open area 12 of the red sub-pixel 10 has a size larger than that of the second down thin-film transistor Tdn2 of the open area 22 of the green sub-pixel 20, and the second down thin-film transistor Tdn2 of the open area 22 of the green sub-pixel 20 has a size larger than that of the third down thin-film transistor Tdn3 of the open area 32 of the blue sub-pixel 30.

As a result of the configuration described above, the light transmittance of the open areas 12, 22, and 32 of the red, green, and blue sub-pixels 10, 20, and 30 may be lowered to be near the light transmittance of the color filter areas 11, 21, and 31 of the red, green, and blue sub-pixels 10, 20, and 30. Thus, there may be little or no difference between the light transmittance of the open areas 12, 22, and 32 and the light transmittance of the color filter areas 11, 21, and 31.

As described above, the light transmittance depends on the size of the cell gap. As a result, the ratio of the sizes of the first to third down thin-film transistors Tdn1, Tdn2, and Tdn3 may be differently set according to the size of the cell gap.

As a result, the transparent display apparatus according to the exemplary embodiment described above may reduce the difference between the light transmittance of the color filter areas of the red, green, and blue sub-pixels, and the light transmittance of the open areas of the red, green, and blue sub-pixels, which may reduce or prevent display defects such as, for example, a yellowish discoloration.

While the present invention has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. A transparent display apparatus, comprising:

a display panel comprising a plurality of pixels arranged in a plurality of rows and columns, wherein each of the pixels comprises a plurality of sub-pixels arranged in a row direction;

a plurality of gate lines, wherein each gate line is operatively coupled to sub-pixels arranged in a corresponding row;

a plurality of data lines comprising first data lines and second data lines, wherein each first and second data line is operatively coupled to sub-pixels arranged in a corresponding column;

a gate driver configured to sequentially apply a gate signal to the pixels through the gate lines; and a data driver configured to apply a plurality of sub-data signals to the sub-pixels through the first data lines, and apply a plurality of down data signals to the sub-pixels through the second data lines, wherein each of the down data signals has a voltage level lower than a voltage level of a corresponding sub-data signal, wherein the plurality of sub-pixels includes a red sub-pixel, a green sub-pixel, and a blue sub-pixel, the plurality of down data signals includes a first down data signal provided to the red sub-pixel, a second down data signal provided to the green sub-pixel, and a third down data signal provided to the blue sub-pixel, a voltage level of the first down data signal is lower than a voltage level of the second down data signal, and a voltage level of the second down data signal is lower than a voltage level of the third down data signal.

2. The transparent display apparatus of claim 1, wherein each of the sub-pixels comprises:

a color filter area; and an open area, wherein the color filter area and the open area each have a rectangular shape.

3. The transparent display apparatus of claim 2, wherein the color filter area comprises a first thin-film transistor configured to be turned on in response to the gate signal provided through a corresponding gate line, and a first pixel electrode configured to receive a corresponding sub-data signal through a first data line operatively coupled to the first pixel electrode by the turned-on first thin-film transistor, wherein the open area comprises a second thin-film transistor configured to be turned on in response to the gate signal provided through the corresponding gate line, and a second pixel electrode configured to receive a corresponding down data signal through a second data line operatively coupled to the second pixel electrode by the turned-on second thin-film transistor.

4. The transparent display apparatus of claim 2, wherein each of the pixels receives a first sub-data signal, a second sub-data signal, and a third sub-data signal from among the plurality of sub-data signals, wherein the first, second, and third sub-data signals are applied to the color filter area of the sub-pixels of each pixel, and the first, second, and third down data signals are applied to the open area of the sub-pixels of each pixel.

5. The transparent display apparatus of claim 2, wherein the open area has a light transmittance substantially equal to a light transmittance of the color filter area in each sub-pixel.

6. The transparent display apparatus of claim 2, wherein each of the sub-pixels comprises:

a first base substrate;

a first pixel electrode disposed on the first base substrate;

a second pixel electrode disposed on the first base substrate and spaced apart from the first pixel electrode;

a second base substrate facing the first base substrate;

a color filter substrate disposed on the second base substrate and overlapping the first pixel electrode;

a common electrode disposed on the second base substrate and the color filter substrate; and a liquid crystal layer disposed between the first base substrate and the second base substrate.

7. The transparent display apparatus of claim 6, wherein the color filter area comprises:

a portion of the first base substrate;

the first pixel electrode;

a portion of the second base substrate;

the color filter substrate; and a portion of the common electrode disposed on the color filter substrate.

8. The transparent display apparatus of claim 7, wherein the open area comprises:

a portion of the first base substrate;

the second pixel electrode;

a portion of the second base substrate; and a portion of the common electrode disposed on the second base substrate.

9. The transparent display apparatus of claim 8, wherein a cell gap between the common electrode and the first pixel electrode in the color filter area is smaller than a cell gap between the common electrode and the second pixel electrode in the open area.

10. The transparent display apparatus of claim 9, wherein the cell gap of the color filter area is about three micrometers and the cell gap of the open area is about four micrometers.

11. The transparent display apparatus of claim 2, wherein the color filter area has a size different from a size of the open area in each of the sub-pixels, and the open area in each of the sub-pixels have different sizes from each other.

12. A pixel of a display panel, comprising:

a first sub-pixel, a second sub-pixel, and a third sub-pixel, each sub-pixel comprising a color filter area and an open area, wherein the color filter area of the first sub-pixel is configured to receive a first sub-data signal through a first data line and the open area of the first sub-pixel is configured to receive a first down data signal through a second data line, wherein the color filter area of the second sub-pixel is configured to receive a second sub-data signal through a third data line and the open area of the second sub-pixel is configured to receive a second down data signal through a fourth data line, wherein the color filter area of the third sub-pixel is configured to receive a third sub-data signal through a fifth data line and the open area of the third sub-pixel is configured to receive a third down data signal through a sixth data line, wherein the first down data signal has a voltage level lower than a voltage level of the first sub-data signal, the second down data signal has a voltage level lower than a voltage level of the second sub-data signal, and the third down data signal has a voltage level lower than a voltage level of the third sub-data signal, wherein the first sub-pixel is a red sub-pixel, the second sub-pixel is a green sub-pixel, and the third sub-pixel is a blue sub-pixel, the voltage level of the first down data signal is lower than the voltage level of the second down data signal, and the voltage level of the second down data signal is lower than the voltage level of the third down data signal.

13. The pixel of claim 12, wherein the open area has a light transmittance substantially equal to a light transmittance of the color filter area in each sub-pixel.

14. The pixel of claim 12, wherein the open area in the red sub-pixel has a first light transmittance, the open area in the green sub-pixel has a second light transmittance, the open area in the blue sub-pixel has a third light transmittance, and the first, second, and third light transmittances are different from one another.

* * * * *